United States Patent [19]

Clark et al.

[11] 4,206,996

[45] Jun. 10, 1980

[54] JOB RECOVERY METHOD AND APPARATUS

[75] Inventors: Gary A. Clark; Frederick W. Johnson, both of Longmont; George G. Promis, Jr., Arvada, all of Colo.

[73] Assignee: International Business Machines Corporation, Armonk, N.Y.

[21] Appl. No.: 903,346

[22] Filed: May 5, 1978

[51] Int. Cl.[2] ..... G03G 15/00

[52] U.S. Cl. ..... 355/14 C; 235/92 SB; 355/14 R

[58] Field of Search ..... 355/3 R, 3 SH, 14, 14 R, 355/14 C; 235/92 SB

[56] References Cited

U.S. PATENT DOCUMENTS

| | | | |
|---|---|---|---|
| 3,588,472 | 6/1971 | Galster et al. | 355/14 X |
| 3,944,794 | 3/1976 | Reehil et al. | 355/14 X |
| 4,054,380 | 10/1977 | Donohue et al. | 355/14 |
| 4,125,325 | 11/1978 | Batchelor et al. | 355/14 X |
| 4,130,354 | 12/1978 | Steiner | 355/14 X |
| 4,134,672 | 1/1979 | Burlew et al. | 355/14 |

*Primary Examiner*—Fred L. Braun

*Attorney, Agent, or Firm*—O'Rourke & Harris

[57] ABSTRACT

Method and apparatus are described for job recovery when jamming of copies occurs in copying devices generating duplex copies electrophotographically from either simplex or duplex originals. Recovery from jams while copying the first side of simplex or duplex originals can normally be immediately effected during the initial, or normal, run, after clearing the jam. Recovery from jams during copying of the second side is effected by clearing the jammed copies from the copying device, optionally inserting blank sheets as the initial copying run is continued to flag the position of each of the removed jammed copies in the generated stack of copies, rerunning the originals through the copying device after completion of the initial copying run with duplex copies being generated only as necessary to replace jammed copies occurring during the initial run, and then inserting the duplex copies last made in the proper positions in the stack of copies made during the initial run, which copies replace the blank flagging sheets, if utilized. The apparatus includes a plurality of counters, memory registers and comparators interconnected by logic circuitry to semi-automatically effect job recovery due to jammed copies occurring during duplex copying from either simplex or duplex originals.

48 Claims, 26 Drawing Figures

JOB RECOVERY METHOD AND APPARATUS

FIELD OF THE INVENTION

This invention relates to job recovery from jammed copies in copying devices and, more particularly, relates to job recovery from jammed copies in electrophotographic copying devices generating duplex copies from simplex or duplex originals.

BACKGROUND OF THE INVENTION

Reproduction, or copying, systems have been known and utilized for some time. Among the more successful of such systems is that accomplished electrophotographically, and many types of machines and methods for accomplishing the desired end have been proposed and/or utilized.

As would be expected, copying machines, including auxiliary devices used in combination therewith or as a part thereof, have undergone many refinements and, at least in some cases, while such refinements have greatly increased the usefulness of such machines, these refinements have also increased costs as well as presenting problems in assuring complete copying of originals.

Included in the many refinements to copying machines that have heretofore been suggested or have occurred, is the development of auxiliary devices for feeding originals to the copying area of the copying machine, including automatic feeding, and development of collating, or collecting, devices to receive and handle the copy sheets forwarded from the copying area after copying has occurred. Document feeding devices are shown, for example, in U.S. Pat. Nos. 3,552,739; 3,556,511; 3,556,512; 3,556,513; 3,565,420; 3,630,515; and 3,815,896, while copy collecting devices are shown, again by way of example, in U.S. Pat. Nos. 3,460,824 and 3,841,754.

Also included in the many refinements in copying machines that have heretofore been suggested or have occurred is the development in such machines of the capability to make duplex copies (i.e., to copy on both sides of a sheet of copy paper). This is important not only where exact copying is desired of duplex original documents, but it is also important in other respects as, for example, in saving paper costs and/or filling space. Duplex copying is shown, for example, in U.S. Pat. Nos. 3,615,129; 3,645,615; and 3,841,754, with the latter including a feeding mechanism and a sorting, or collecting, device in conjunction therewith.

Duplex copying from simplex originals can normally be accomplished today on many different types of copying machines. The degree of difficulty encountered, as well as the required handling of originals and/or copies, depends, however, at least in part, upon the degree of sophistication of the operator.

In addition, at least some commonly available commercial copying machines can provide automatic generation of duplex copies, but the required components and/or circuitry involved is complicated and results in costs for such units that are higher than might be justified to at least some users.

For duplex copying from either simplex or duplex originals, assurance of complete copying, as desired, for each original, has presented additional problems, even when using automatic machines for generating duplex copies, particularly where jams occur during second side copying. While the copying device could be stopped, the jam cleared, new first side copies generated, the newly generated copies positioned to replace the jammed copies, and the run then continued to make the desired second side copies each time that a jam occurred, this would obviously be not only timewise inefficient, but would also be complicated and possibly inexact, and therefore unacceptable for many uses and/or users.

As an alternative, each jam could, of course, be cleared from the copying machine and the run completed with or without regard for missing copies, but the generated stack of copies would then have to be carefully reviewed for missing copies, if not flagged, the corresponding originals found in the stack of originals and rerun, and then the newly generated copies inserted in the stack of copies and the corresponding originals returned to the stack of originals. Here again, this would be timewise inefficient as well as requiring a considerable amount of document and copy handling.

Apparatus has been suggested for enabling more precise selection of copies that need to be recopied after a jam. See, for example, U.S. Pat. No. 3,588,472 where a jam is detected and an operator is informed of the amount of back-up necessary for completion of copying by counting the number of sheets entering the transport path of the copying device and counting the number of sheets emerging from the transport path followed by comparing these counts with the number of copies desired and providing a count for display utilizing a reversible counter.

Job recovery apparatus and methods heretofore suggested for replacement of jammed copies, do not, however, permit a normal run to be completed before missing copies, due to jams, are made without requiring extensive manual sorting and/or handling of documents and/or copies.

SUMMARY OF THE INVENTION

This invention provides improved job recovery in a copying machine that simplifies recovery from copy jams without necessitating undue machine costs or requiring excessive time to effect such recovery. Recovery from jams is effected after the initial, or normal, run has been completed, with copies being thereafter made only of originals corresponding to missing copies, which copies are then combined with the copies made during the normal run, whereby document and/or copy handling is minimized and the chances for operator error reduced.

It is therefore an object of this invention to provide an improved method and apparatus for job recovery due to jammed copies.

It is still another object of this invention to provide an improved method and apparatus for job recovery when jams occur in a copying device generating duplex copies.

It is still another object of this invention to provide an improved method and apparatus for jam recovery that is simplified, yet dependable, in providing duplex copies of all originals copied by a copying device.

It is still another object of this invention to provide an improved method and apparatus for job recovery that does not require excessive time or necessitate undue cost in effecting recovery after a jam has occurred in a copying machine.

It is another object of this invention to provide an improved apparatus and method for job recovery due to jammed copies whereby document and/or copy handling is minimized and the chances for operator error reduced.

It is yet another object of this invention to provide an improved method and apparatus for job recovery wherein the initial run to generate duplex copies is completed prior to generation and insertion of missing copies due to jams.

With these and other objects in view which will become apparent to one skilled in the art as the description proceeds, this invention resides in the novel method, construction, combination, and arrangement of parts substantially as hereinafter described and more particularly defined by the appended claims, it being understood that such changes in the precise embodiment of the herein disclosed invention are meant to be included as come within the scope of the claims.

BRIEF DESCRIPTION OF THE DRAWINGS

The accompanying drawings illustrate a complete embodiment of the invention according to the best mode so far devised for the practical application of the principles thereof, and in which.

DESCRIPTION OF THE INVENTION

Figure 1:
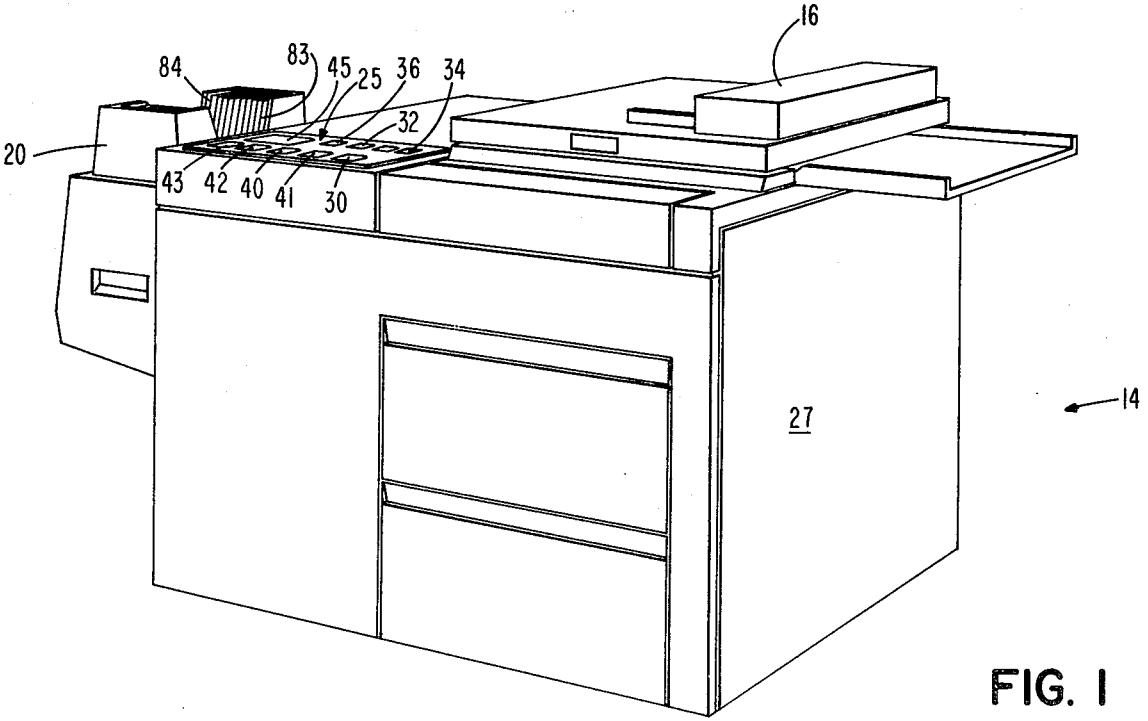
FIG. 1 is a perspective view of an electrophotographic copying machine having this invention incorporated therein.
Figure 2:
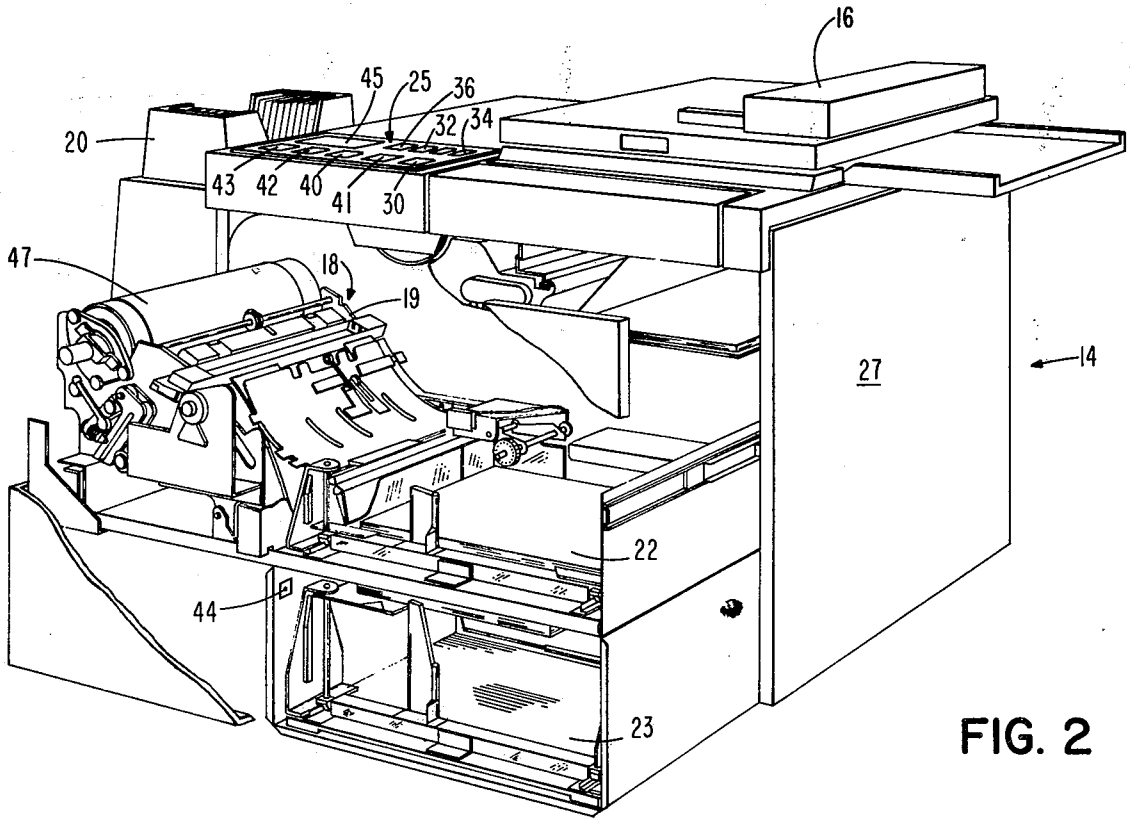
FIG. 2 is a partial disassembled view of the copying machines shown in FIG. 1 to illustrate features thereof.
Figure 3:
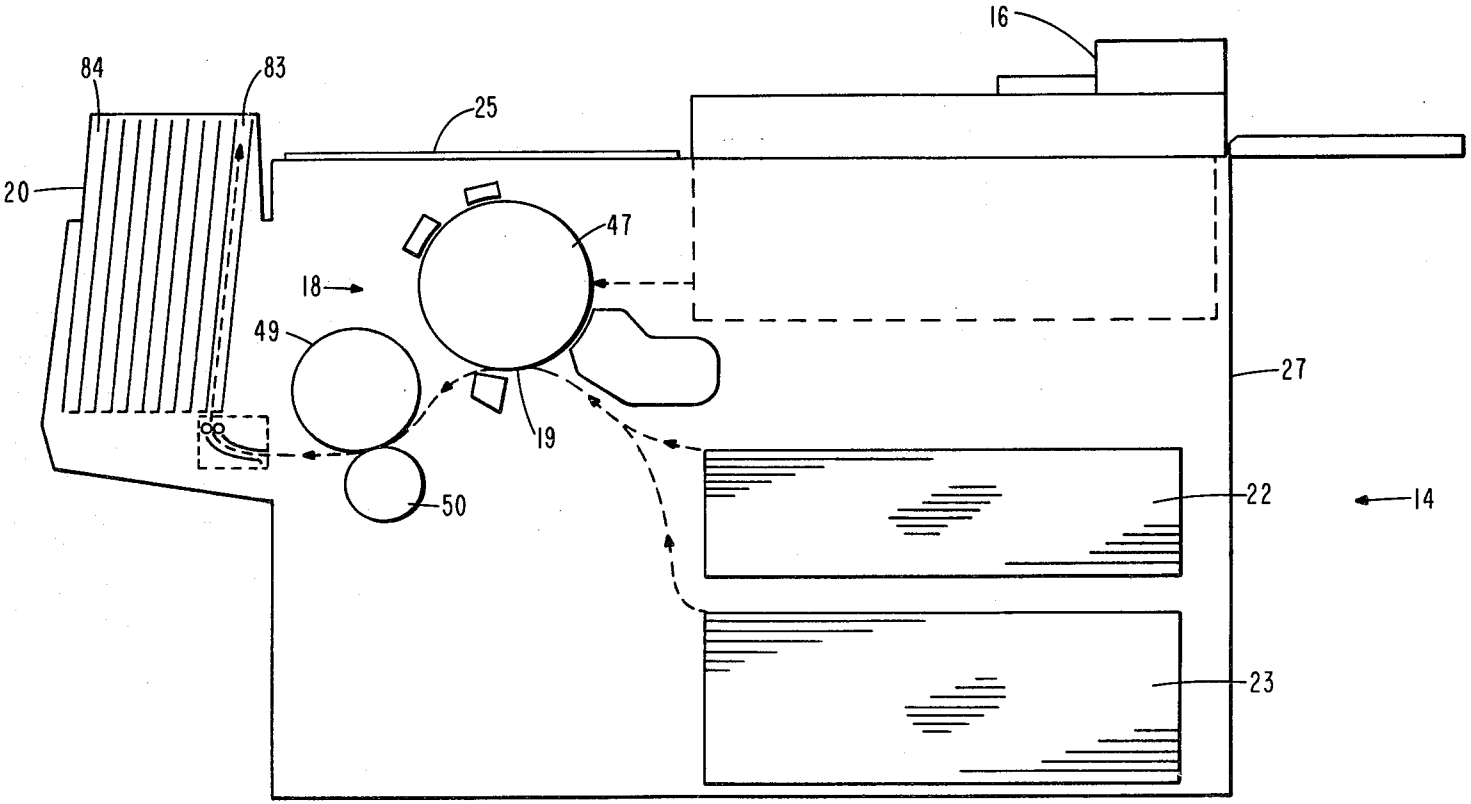
FIG. 3 is a schematic representation showing the path of copy paper from the storage tray through the copying area to the collator.

Referring now to the drawings, electrophotographic copying machine 14, as shown in FIGS. 1, 2 and 3, has this invention incorporated therein. As shown, copy machine 14 typically includes a document feeding mechanism 16, a copying area 18 having copying mechanism 19 thereat (see FIG. 2), a collector, or collator, 20, main and alternate copy paper receptacles, or trays, 22 and 23, a control panel 25 and a housing 27 enclosing the machine.

As is conventional, housing 27 includes a plurality of removable access panels and/or doors to permit access to the interior of the machine as is needed.

As is also conventional, control panel 25 has a plurality of switches and indicators thereon, such as a power on/off switch 30, a start print switch 32, a copy number selection switch 34, and various indicators 36 utilized in conjunction with the switches on the panel. In addition, a simplex/duplex selection switch 40, a duplex/duplex selection switch 41, a jam recovery switch 42, and a cancel jam recovery switch 43 are provided on the control panel (a second pass switch 44 is preferably positioned in the paper tray area but could be positioned on the control panel), as are special message indicators (designated generally by the numeral 45) to instruct the operator both as to second side copying to carry out the duplexing operation and as to job recovery.

As utilized herein, the operator is instructed, at each particular stage, by displaying one or more messages as brought out more fully hereinafter. The complete message table is as follows:

OPERATOR MESSAGE TABLE

A. Remove copies from collator, position copies in copy paper supply drawer oriented as shown thereat, depress second pass button, close copy paper supply drawer, remove originals from ADF exit tray, place originals in ADF input hopper, and press start print button.

B. Remove stack of originals from ADF exit tray, turn stack over, place inverted stack in ADF input hopper, and press start print button after all displayed instructions have been completed.

C. Remove copies from collator, place copies in paper supply drawer oriented as shown thereat, depress second pass button, and close copy paper supply drawer.

D. Clear jammed sheets from copies and press start print button.

E. Job is not complete. To remake duplex copies jammed during second pass, follow instructions of all other displayed messages. If no jammed copies are to be remade, or if the remake process is to be discontinued, press the cancel job recovery button. Job recovery is not complete while this message is displayed.

F. Remove stack of originals from ADF exit tray, place stack in ADF input hopper without turning stack over, and press start print button after all displayed instructions have been completed.

G. Remove copies from collator and set aside.

H. Remove replacement copies in collator and hand-collate into proper position with respect to copies. Set aside before commencing job recovery (if blank flagging sheets are utilized, then this message instructs operator to hand-collate the replacement copies into the blank sheet positions of the copies set aside before commencing job recovery).

I. Lift ADF lid, turn original on document glass over, close ADF lid, and press start print button when all displayed instructions have been completed.

Copying area 18 of the copy machine includes a rotatable drum 47 and associated stations for carrying out the electrophotographic copying on copy paper supplied from one of the storage trays 22 and 23 as is well known in the art. As indicated in FIG. 3, the copy paper is withdrawn from the storage tray and fed past drum 47 at the copying area 18 with the copy paper then being conveyed between fuser rollers 49 and 50 to collator 20.

Copy machines of this general type are well known and therefore have been detailed herein only to the extent necessary to better explain the invention incorporated therein.

Figure 4:
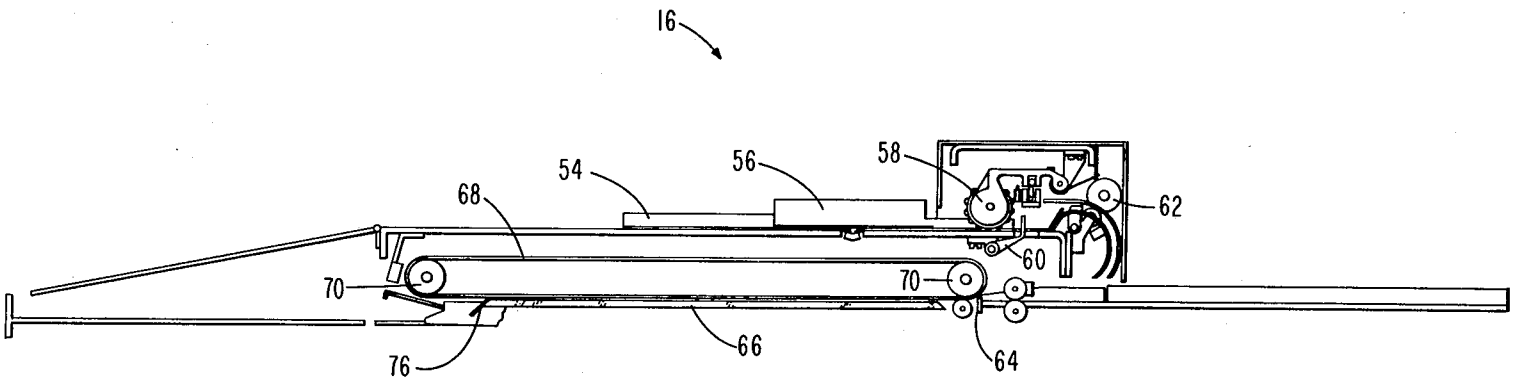
FIG. 4 is a side view with housing partially removed showing the automatic document feeding mechanism.
Figure 5:
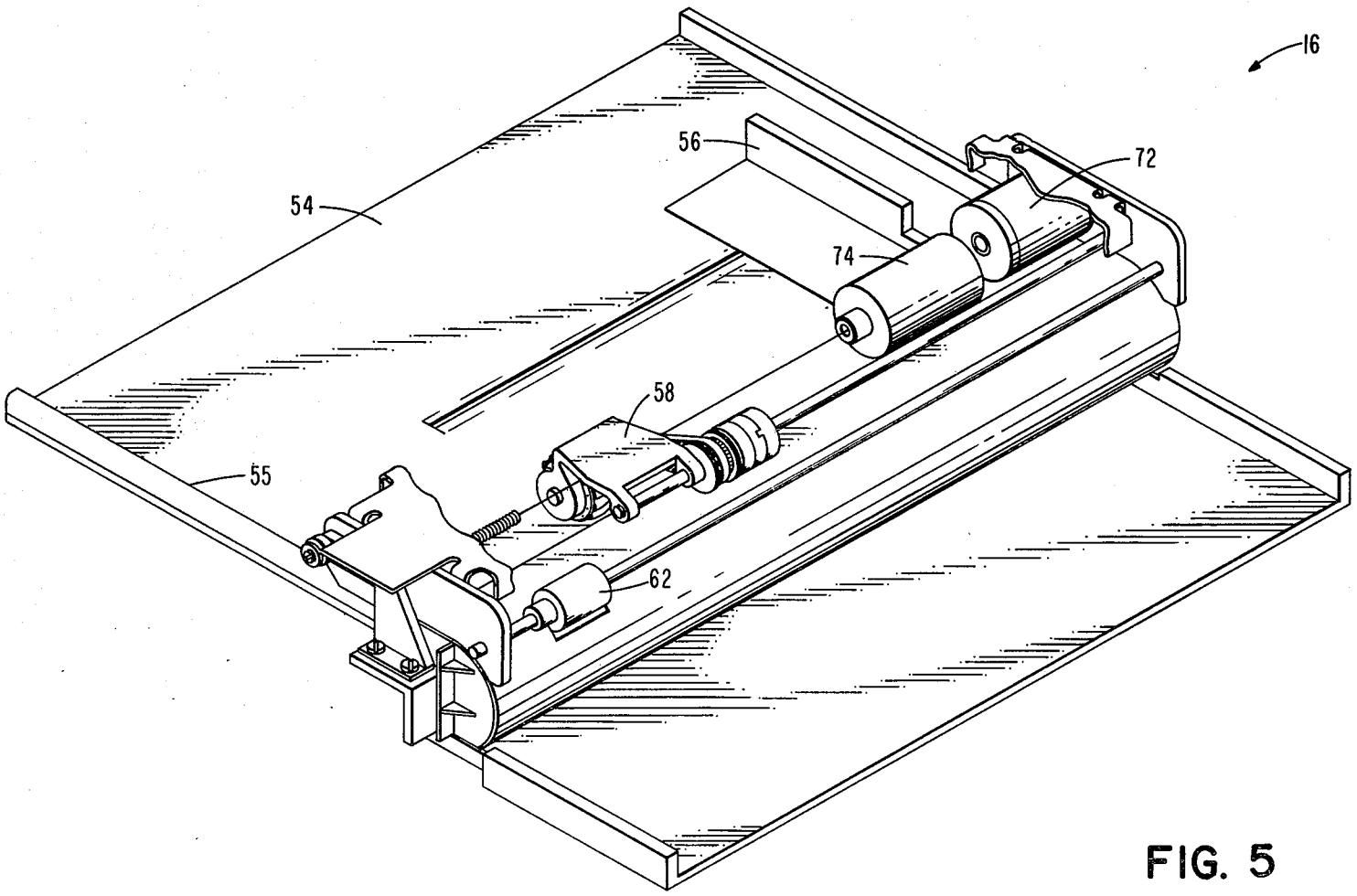
FIG. 5 is a top perspective view with housing partially removed of the automatic document feeding mechanism shown in FIG. 4.

As shown best in FIGS. 4 and 5, an automatic document feeding mechanism 16 is preferably provided. Mechanism 16 includes a document tray 54 for storage, or stacking, of originals thereon to be copied. As shown, tray 54 has a fixed front reference edge 55 and a movable rear reference 56 provided thereon. Each original is sequentially fed by paper feed roll 58 past automatic document feed gate 60 and nip rolls 62 to a gate 64 where each original is sequentially introduced into the copying area 18, and more particularly, positioned on glass platen 66 thereat by means of belt 68 mounted on rollers 70. As shown in FIG. 5, motor 72 drives the paper feed rolls and nip rolls while solenoid 74 is provided to lift the paper feed roll as necessary. Exit gate (and reference edge) 76 is also provided for removal of each original from the glass platen, or document glass, 66 (and hence from the copying area).

Figure 6:
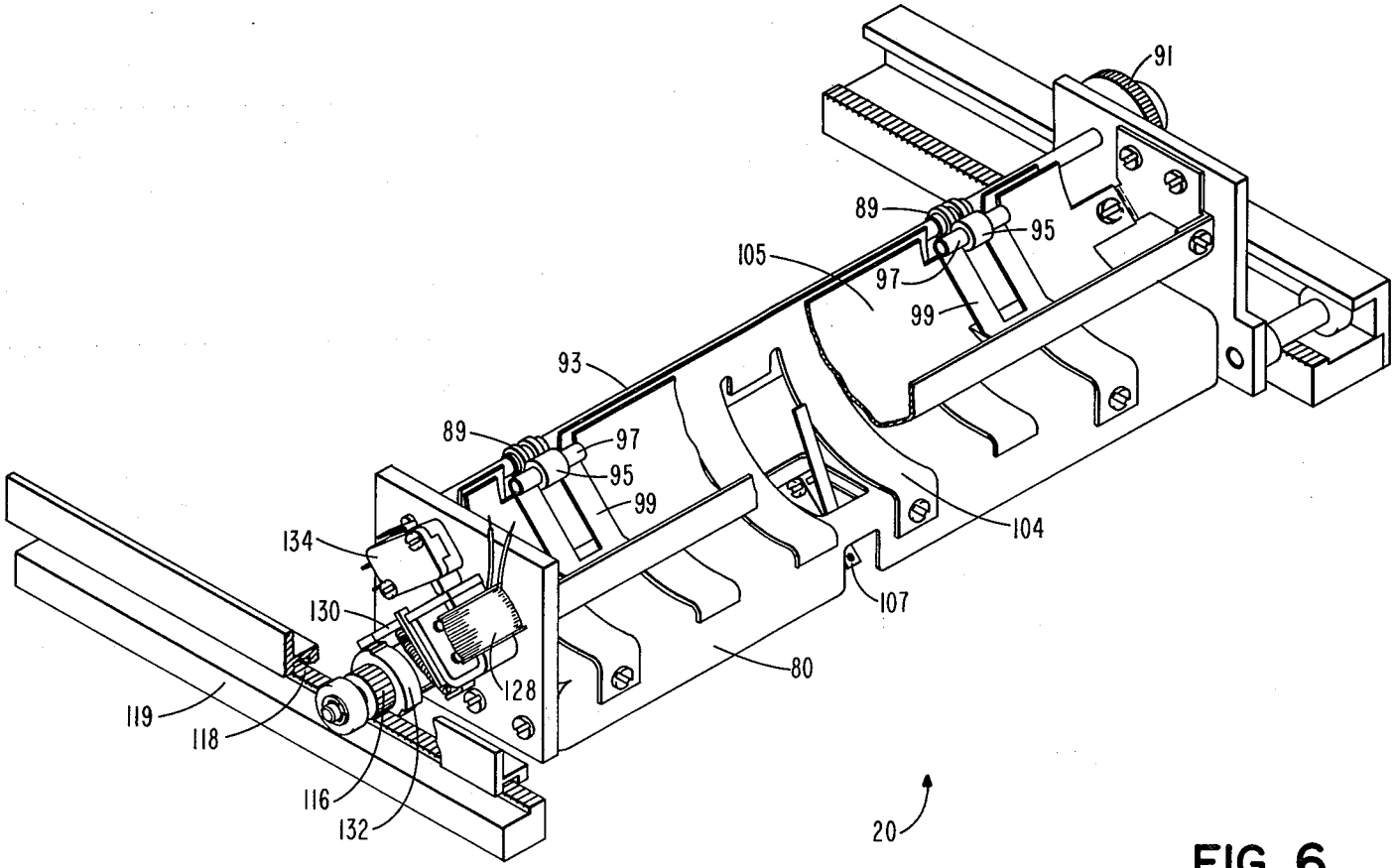
FIG. 6 is a top perspective view of removable portion, or deflector mechanism, of the collator.
Figure 7:
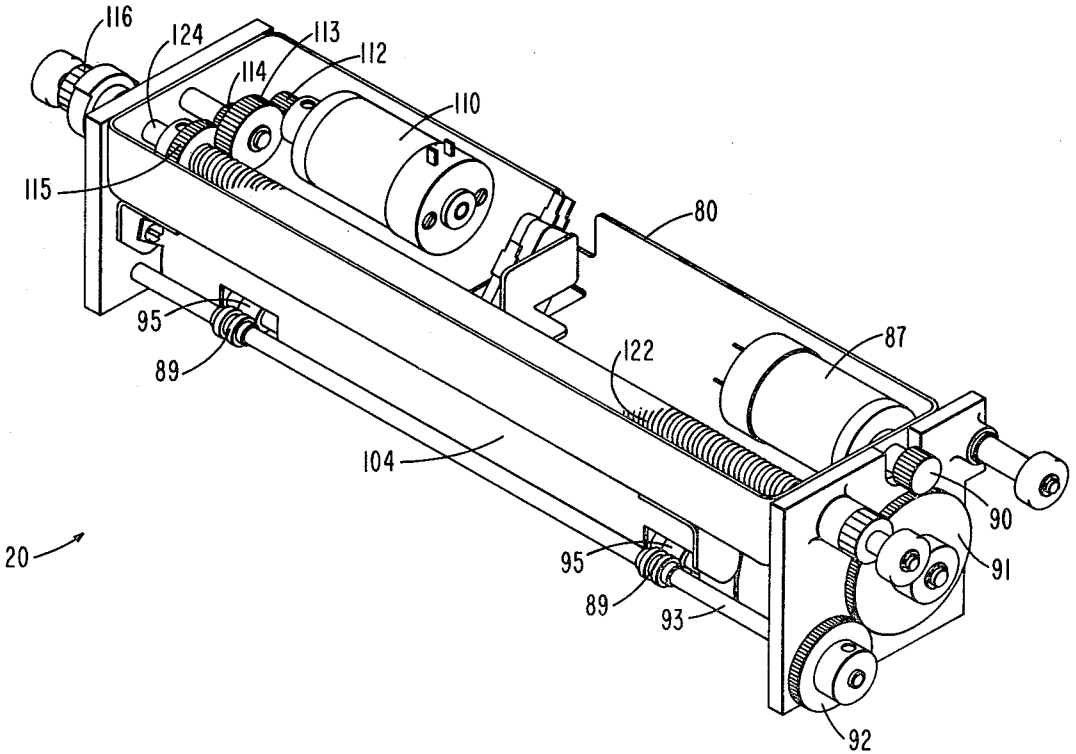
FIG. 7 is a perspective view showing the bottom side of the movable portion of the collator shown in FIG. 6.
Figure 8:
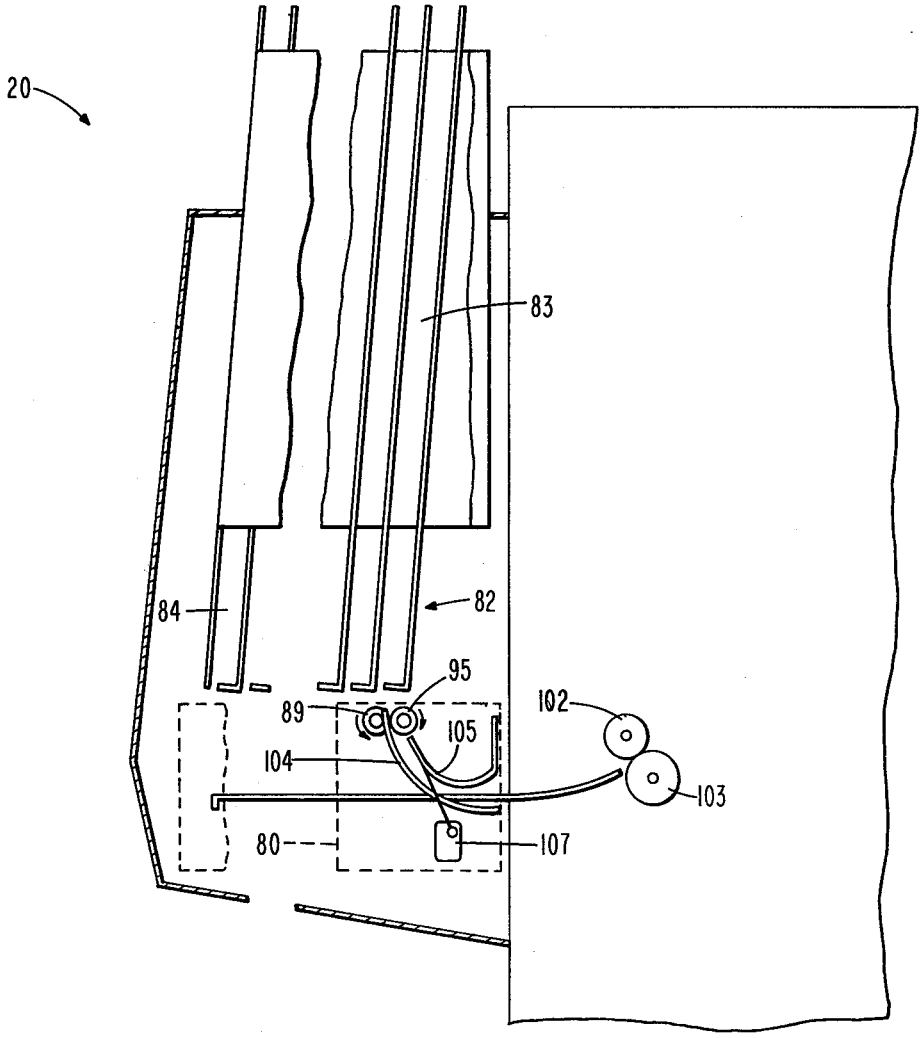
FIG. 8 is a partial side view illustrating the bins of the collator as used in conjunction with the movable portion.

As shown in FIGS. 6 through 8, collator 20 includes a movable deflector portion, or mechanism, 80 for receiving the sheets of copy paper from the copying area and directing the sheets to collecting area 82 which includes a plurality of bins which extend from the first bin 83 nearest the copy machine rearwardly to the last bin 84 positioned most remote from the copying machine. The sheets of copy paper inserted into the bins are inserted behind any sheets then in the bin (i.e., on the rearward side of the bin).

Motor 87 (see FIG. 7) drives rollers 89 through gears 90, 91 and 92, the latter of which is mounted on rotatable shaft 93 having rollers 89 also mounted thereon. As shown in FIG. 6, rollers 95 are mounted on shafts 97 the opposite ends of each of which are mounted in biased mounting plates 99. The copy paper is recieved between rollers 89 and 95 with the paper thereon being conveyed to the proper bin at collating area 82. As also indicated in FIGS. 6 through 8, the copy paper passes between rollers 102 and 103 to curved plates 104 and 105 of the deflector mechanism before reaching rollers 89 and 95. A switch 107 is provided in the path of the copy paper between the curved plates 104 and 105. This switch senses paper presence and also can detect jams.

Deflector mechanism 80 is moved by motor 110 through gears 112, 113, 114, 115, and 116, as shown in FIG. 7, with gear 116 engaging a flat geared surface 118 on frame 119 of the copying machine (as shown in FIG. 6). By this arrangement, the collator can be incremented from bin to bin (as indicated by FIG. 8).

As also shown in FIG. 7, a torque spring 122 is wound about shaft 124 (having gear 115 mounted thereon). This torque spring is used to drive the deflector mechanism from bin 84 to bin 83 (i.e., from the most rearward bin to the nearest bin) when movement in this direction is needed. Solenoid 128 controls operator dog 130 to release ratchet 132 and permit movement of the deflector mechanism by the torque spring. In addition, as is also shown in FIG. 6, switch 134 is provided to ascertain the positioning of the deflector mechanism with respect to each bin of the collecting area by providing a count to the copy machine logic system.

Figure 9:
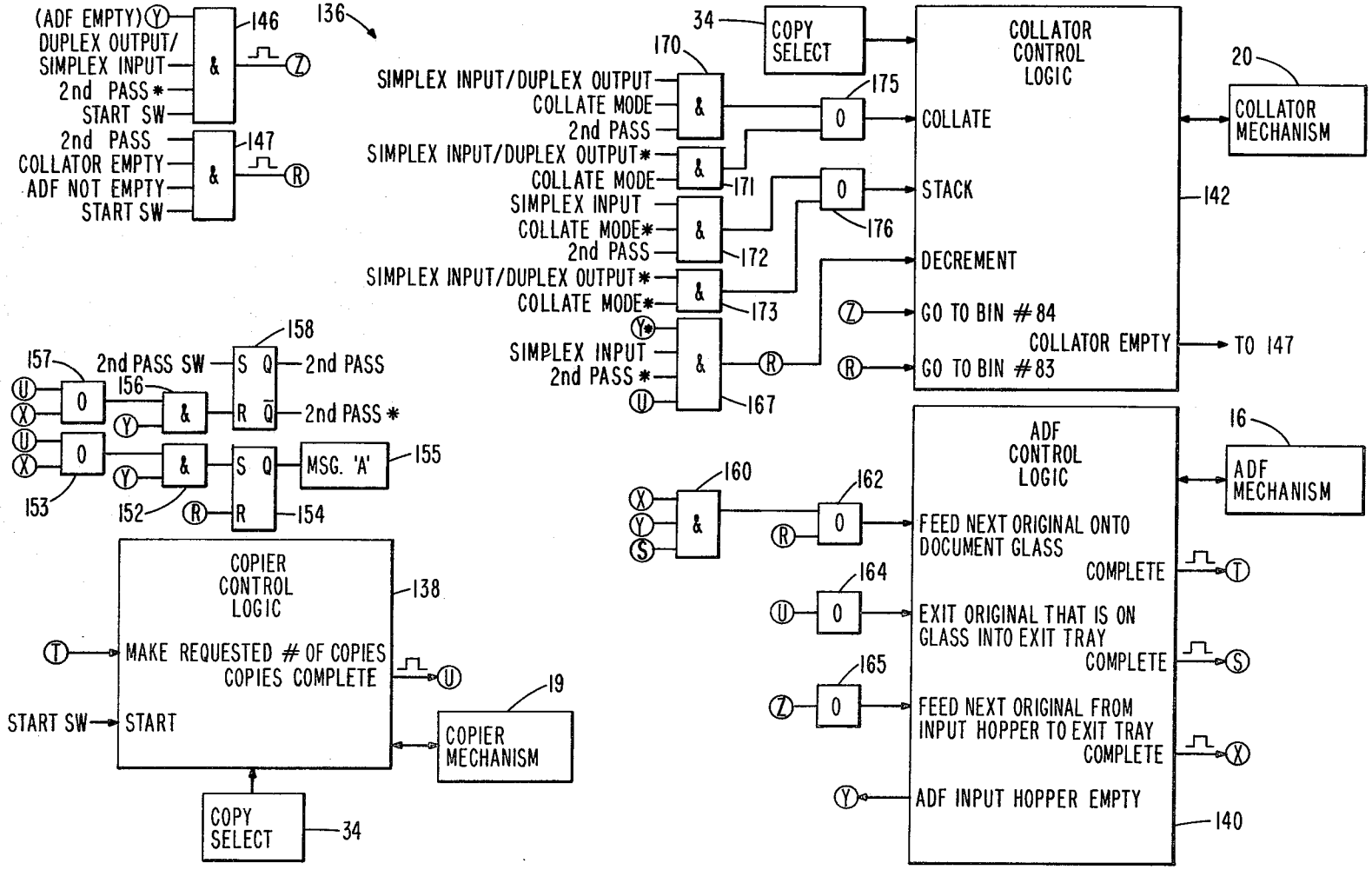
FIG. 9 is an electrical block and schematic diagram of the logic control system for generating duplex copies from simplex originals.

A block and logic schematic diagram of the control system 136 for generation of duplex copies from simplex originals is shown in FIG. 9. As shown, the control system includes a copier control logic unit 138 connected with copier mechanism 19 to control operation thereof, an automatic document feed (ADF) control logic unit 140 connected with automatic document feeding (ADF) mechanism (16) to control operation thereof, and a collator control logic unit 142 connected with collator mechanism 20 to control the operation thereof.

Logic circuitry is connected with each of these control units as indicated in FIG. 9. As shown, the logic circuitry includes AND gates 146 and 147 each of which receives a plurality of inputs as indicated; AND gate 152 which is connected at one input to OR gate 153 and has its output connected to the set input of flip-flop 154, the Q output of which is connected to energize the special message light 155 at the control panel that is, at indicator 45 of control panel 25 of the copy machine, as shown in FIGS. 1 and 2; AND gate 156 which is connected at one input to OR gate 157 and has its output connected to the reset input of flip-flop 158, the Q output of which indicates a second pass of the original documents during the duplexing operation; AND gate 160 the output of which is connected with OR gate 162; OR gates 164 and 165 which along with OR gate 162 have their outputs connected with the automatic document feed control logic unit 140; and AND gate 167 which has its output connected to the collator control logic circuit 142.

The logic circuitry, as also shown in FIG. 9, also includes circuitry for establishing the collate or stacking mode for the duplex sets of copies. This circuitry includes a plurality of AND gates 170, 171, 172, and 173, each of which has a plurality of indicated inputs with the outputs of AND gates 170 and 171 being connected through OR gate 175 to the collator control logic circuit unit 142 and the outputs of AND gates 172 and 173 being connected through OR gate 176 to collator control logic unit 142.

Figure 10:
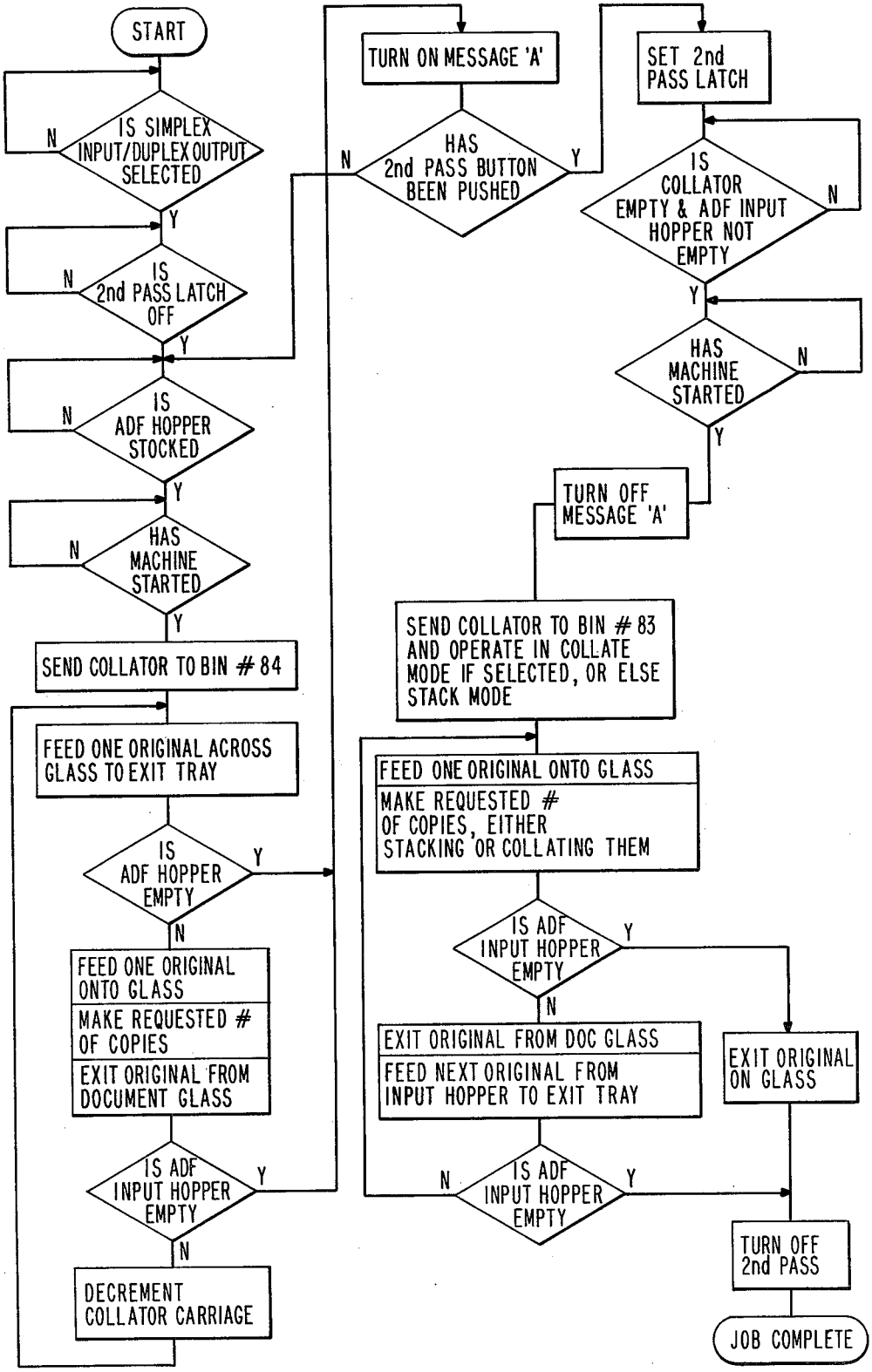
FIG. 10 is a flow diagram illustrating the generation of duplex copies from simplex originals.

Functioning of this control system is illustrated by the flow diagram of FIG. 10. As indicated, at AND gate 146 a determination is made as to whether the simplex input/duplex output is selected, whether the second pass latch is off, whether the automatic document feed hopper is stocked, and whether the machine has started. If the answer is "yes" to all of the foregoing, then an output is coupled from AND gate 146 to the collator control logic unit 142 to cause the collator to be sent to the most remote bin, i.e., bin 84. In addition, a signal is sent to the automatic document feed control logic unit 140 to cause one original to be fed across the glass platen 66 to the exit tray (i.e., the first original is not copied but instead is sent across the copying area without the occurrence of copying). It can be seen from FIG. 9 that the output of AND gate 146 is coupled through OR gate 165 to cause the original to be fed from the input hopper to the output tray.

If the automatic document feed input hopper is not empty, an output from the automatic document feed control logic unit 140 is coupled through AND gate 160 and OR gate 162 to cause feeding of the next original in the sequence onto the glass platen 66. At this time, a signal from ADF control logic unit 140 is coupled to the copier control logic unit 138 to cause the requested number of copies to be made. When the required number of copies have been made, an output from the copier control logic unit 138 is coupled to the automatic document feed control logic unit 140 through OR gate 164 to cause the original then on the glass platen 66 to be exited into the exit tray.

If the automatic document feed input hopper is not then empty, a signal is coupled through AND gate 167 to the collator control logic unit 142 to cause the deflector mechanism to be decremented, that is, to be moved to the next bin. After this has occurred, the next original is fed across the glass to the exit tray (as indicated in flow diagram FIG. 10) and hence the next original (an odd numbered copy in the sequence) is not copied but is passed across the tray. The steps are then repeated for the next original (an even numbered original) that is moved onto the glass platen so that copies are made.

If the hopper is not yet empty, the collator control logic unit 142 causes the deflector mechanism to be decremented to the next bin and the process is continued with copying of even numbered documents and passing odd numbered documents until such time as the hopper is indicated to be empty. At this point, an output is coupled to display a message designated A on the instrument panel (as by lighting the same). The message designated A can, for example, instruct the operator to remove the copies from the collator and position them as shown in a paper drawer or tray, after which the operator is then further instructed to press the second pass button, close the drawer, remove the originals from the automatic document feed exit tray and place them in the automatic document feed input hopper, and then press the start print button.

The first pass having now been completed, the second pass of the documents is commenced. As indicated in the flow diagram of FIG. 10, the first test is whether the second pass button has been pressed. If so, the Q output from flip-flop 158 is provided for indicating second pass and is coupled as one input to AND gate 147. If the collator is empty, if the automatic document feeding mechanism is not empty, and if the start switch is on, then an output is coupled from AND gate 147 to turn off the message display. This output is also coupled to the collator control logic unit 142 to cause the deflector mechanism of the collator to be moved to the bin nearest the copy machine (that is, to bin 83). At this time, the mode selected determines whether the collator will collate the duplex copies or stack the same (see FIG. 9).

The first original is then fed onto the glass platen 66 (due to the signal through AND gate 160 and OR gate 162 to the automatic document feed control logic unit 140) and the requested number of copies are made in the same manner as described hereinabove with respect to the first pass.

After these copies are made, if the automatic document feed mechanism input hopper is not then empty, the next original (an even numbered original) is caused to be moved onto and off of the glass platen in the same manner that the first original was moved onto and off the glass in the first pass (i.e., the second original rather than the first and each even numbered original thereafter is moved across the glass without copying during the second pass). If the ADF input hopper is then not yet empty, the procedure is repeated with each succeeding odd numbered original being moved onto the glass and copied and each succeeding even numbered original being passed without copying.

After all of the originals have been removed from the automatic document feeding input hopper, an indication of the hopper being empty appears and the second pass is completed. As indicated in FIG. 10, the copying job is then complete if no jams have occurred. The duplex copies can then be removed from the collator and are either collated into sets or stacked depending upon the mode selected.

In operation, to generate duplex copies from simplex originals, the operator selects the duplex mode and the number of copies desired before copying is commenced. The copying process is then initiated by "gang feeding" all of the originals into the automatic document feeding mechanism which works in an automatic mode. Each original is in its natural order (for example, 1 through 7 if there are 7 originals). As indicated above, no copies are made of the odd numbered originals during the first pass through the automatic document feeding mechanism (they are shuttled across the glass platen and out of the copying area without making any copies because of the special machine programming associated with the duplex selection). The copying machine does make, however, the appropriate number of copies of each of the even numbered originals during this first pass as "side two" copies. The machine logic is programmed to stack the copies in reverse order from normal in the collator when the duplex mode has been selected and first pass copies are being generated, Thus, copies of original number 6 are stacked in bin 84 of the collator and copies of the original number 4 are stacked in the adjacent bin of the collator, etc. where seven originals are being copied.

After all the originals have passed through the automatic document feed mechanism, the operator removes the copies (of the even numbered originals) and places them in their proper orientation back into the same paper tray used in making these copies. The job is completed, if no jams occur, including collating the copies (if the collate mode is selected), by again passing the originals through the automatic document feeding (ADF) mechanism. During this second pass, "side one" copies are made only of the odd numbered originals and the even numbered originals are merely shuttled across the glass platen without making copies (due to the copy machine logic circuitry as set forth hereinabove).

The method and apparatus for generating duplex copies from simplex originals is described and claimed in U.S. patent application, entitled "METHOD AND APPARATUS FOR GENERATING DUPLEX COPIES ELECTROPHOTOGRAPHICALLY FROM SIMPLEX ORIGINALS", now U.S. patent application Ser. No. 903,277, filed May 5, 1978 by Carl A. Queener and Gary A. Clark and having a common assignee with respect to this application.

Figure 11:
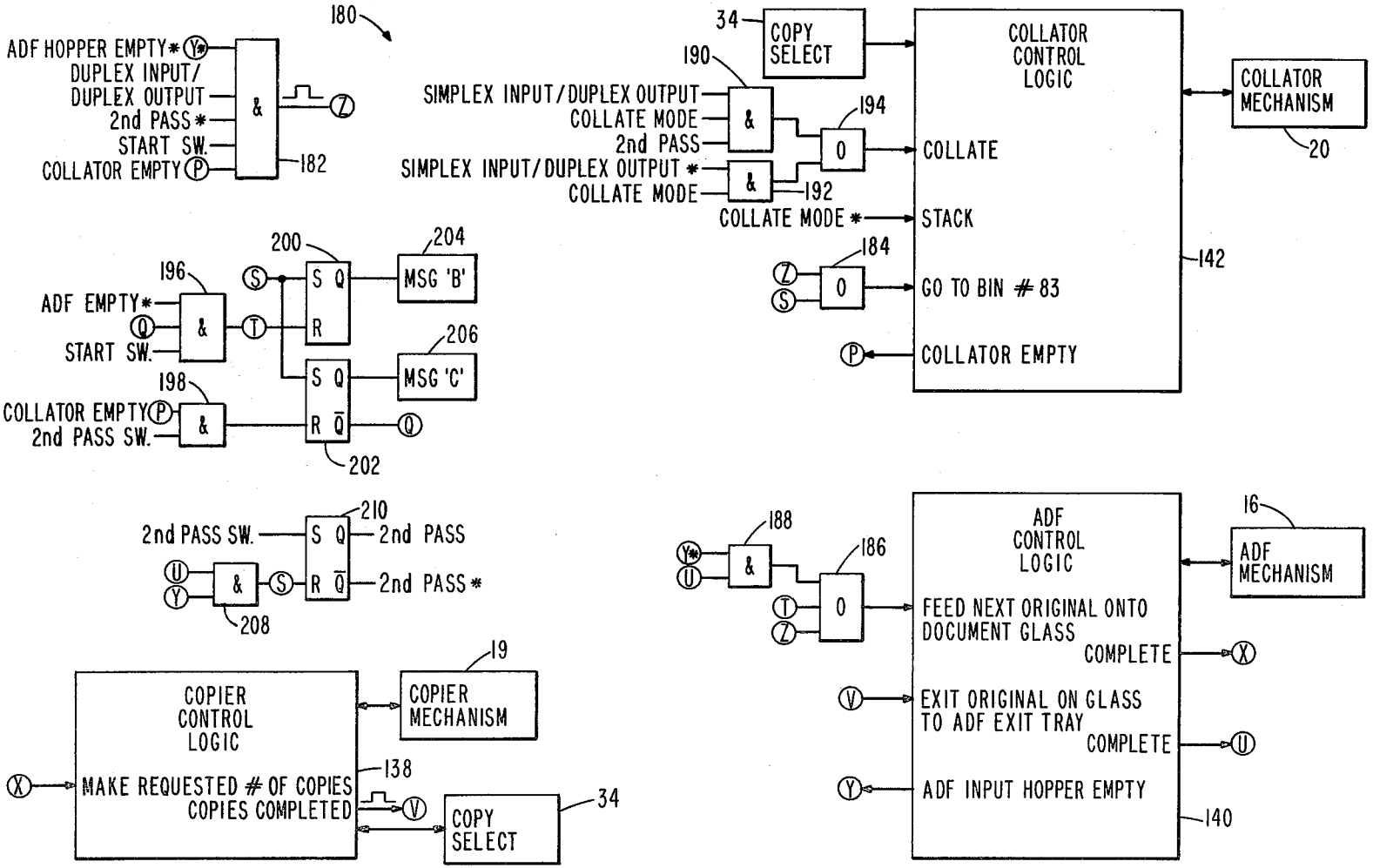
FIG. 11 is an electrical block and schematic diagram of the logic control system for generating duplex copies from duplex originals.

A block and schematic diagram of control system 180 for controlling generation of duplex copies from duplex originals is shown in FIG. 11.

This control system includes copier control logic unit 138 connected with copier mechanism 19 (as also shown and described in connection with FIG. 9) to control operation thereof. An automatic document feed (ADF) control logic unit 140 is connected with automatic document feeding (ADF) mechanism 16 (as also shown and described in connection with FIG. 9) to control operation thereof, and a collator to control logic unit 142 is connected with collating mechanism 20 (as also shown and described in connection with FIG. 9) to control the operation thereof.

Logic circuitry interconnects these control units as indicated in FIG. 11 for generating duplex copies from duplex originals. As shown, the logic circuitry includes AND gate 182 receiving a plurality of inputs as indicated; OR gate 184 having the output of AND gate 182 as one input thereto; OR gate 186 having the output of AND gate 188 coupled thereto as one input; AND gates 190 and 192 each of which has a plurality of inputs as indicated and couples an output to OR gate 194; AND gates 196 and 198 each of which has a plurality of inputs as indicated and each of which supplies a reset input to flip-flops 200 and 202, respectively which flip-flops energize message displays, or indicators, 204 and 206, respectively; and AND gate 208 which supplies a reset pulse to flip-flop 210, which flip-flop supplies second pass output information.

Figure 12:
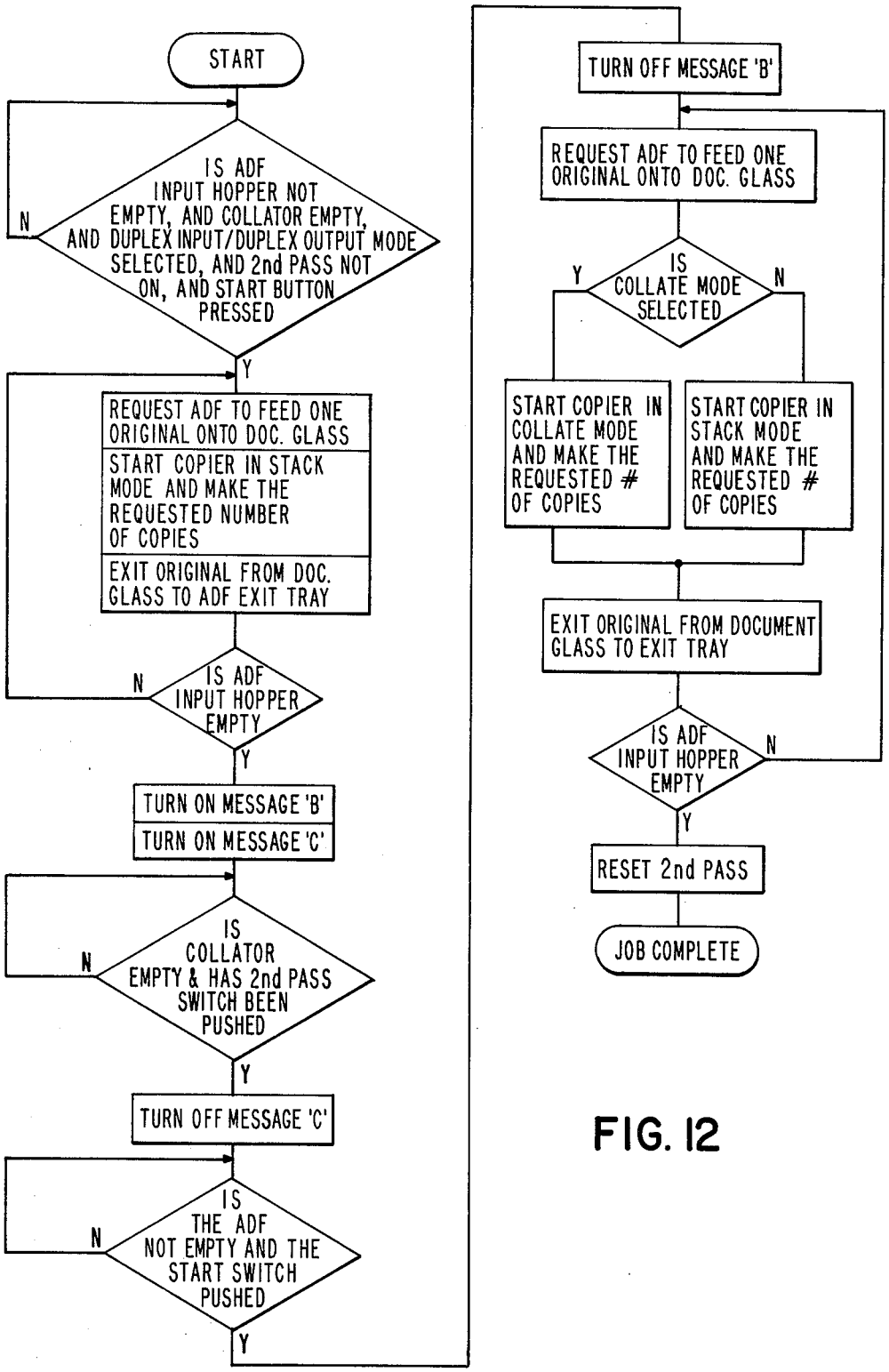
FIG. 12 is a flow diagram illustrating generation of duplex copies from duplex originals.

Functioning of the control system to generate duplex copies from duplex originals is illustrated by the flow diagram of FIG. 12. As indicated, when a determination is made (at AND gate 182) that the ADF input hopper is not empty, that the collator is empty, that the duplex input-duplex output mode has been selected, that it is not a second pass, and that the start switch is depressed, then an output is provided (from AND gate 182 through OR gate 184 to collator control logic unit 142) to cause the collator mechanism to be moved so that the first (i.e., closest bin 83) will receive generated copies. In addition, a signal is coupled to the automatic document feeding control logic unit 140 through OR gate 186 to cause the next original to be fed onto glass platen 66.

Upon completion of movement of the next original onto glass platen 66, a signal is coupled to the copier control logic unit 138 to cause the copier mechanism 19 to make the requested number of copies as selected by copier select switch 34. At this point, the collator control logic unit 142 is in the stack mode.

After the requested number of copies have been made, a signal from copier control logic unit 138 is supplied to the ADF control logic unit 140 to cause the original then on glass platen 66 to be removed therefrom and exited to the exit tray. When this is completed, if the ADF input hopper is not then empty, the next original is moved onto the glass platen and the required number of copies made. This process in continued until the ADF input hopper is empty.

When the ADF hopper is empty, outputs are coupled from the ADF control logic unit 140 through AND gate 208 to set flip-flop 200 and thereby cause a message (indicated as B) to be displayed to the operator at indicator 204. This message to the operator preferably states operational information instructing the operator to remove the stack of originals from the ADF exit tray, turn it over, place the stack in the ADF input hopper and press the start switch when all of the indicated instructions have been completed.

At this time, a second message (indicated as C) is also displayed at indicator 206 since a set input is also supplied to flip-flop 202. This message preferably states operational information instructing the operator to remove the copies from the collator, place them in the paper supply bin, or drawer, oriented as shown on the placard in the bin, and then depress the second pass button located in the bin.

When the collator is empty and when the second pass switch has been depressed, then the display of the message designated C is terminated since an output is then coupled through AND gate 198 to reset flip-flop 202. Likewise, if the ADF input hopper is not empty and the start switch is depressed, then the display of the message designated B is terminated since an output is then coupled through AND gate 196 to reset flip-flop 200. At this point, an output from AND gate 196 is coupled through OR gate 186 to ADF control logic unit 140 to cause the first original to be moved onto glass platen 66.

With duplex input/duplex output having been selected and with a second pass occurring, if the collate mode has been selected, then an output is provided by AND gate 190 through OR gate 194 to place collator control logic unit 142 in the collate mode. If the stack mode is selected, however, then collator control logic unit 142 is left in the stack mode. In either case, the requested number of copies of each original are made when a signal is received by the copier control logic unit 138 from the ADF control logic unit 140.

After the requested number of copies have been made, a signal from the copy control logic unit 138 is coupled to the ADF control logic unit 140 to cause the original then on the glass platen to be exited to the exit tray. If the ADF input hopper is not then empty, the next original is fed onto the glass platen and the selected number of copies made with the copies then being collated or stacked as determined by the mode selected. This process is continued until the ADF input hopper is empty, at which time second pass flip-flop 210 is reset and the job is then completed if no jams have occurred.

In operation to generate duplex copies from duplex originals, the operator depresses the duplex input/duplex output button 41 and selects the number of copies desired before copying is commenced. The copying process is then initiated by "gang feeding" all of the originals into an automatic feeding mechanism which operates in an automatic mode. Each original is then copied on one side of separate sheets of copy paper, after which the sheets are removed from the collator and returned to the paper supply bin for copying on the second side. The originals are then flipped over and returned to the ADF input hopper. The originals are then rerun so that duplex copies are generated from the duplex originals.

This invention is capable of effecting job recovery due to jammed copies when duplex copies are made from either simplex or duplex originals as described hereinbefore. In either case, if a jam occurs during copying of the first side, the copying device is cleared and copying is resumed by again making copies to replace the unacceptable copies involved in the jam. If a jam occurs, however, on the second side to be copied, then job recovery as set forth hereinabove is utilized and includes, generally, clearing the jammed copies from the copying device, optionally flagging the missing copies by inserting blank sheets as the normal run is continued, rerunning the originals with duplex copies being generated only as necessary to replace jammed copies occurring during the normal copying run, and inserting the duplex copies last made in the proper positions in the stack of copies made during the normal run, which includes inserting the duplex copies last made in place of the blank flagging sheets where utilized, to thus generate complete sets of duplex copies from the originals (whether simplex or duplex).

A block and schematic diagram of the control system for effecting jam recovery is shown in FIGS. 13 through 17, when taken together.

Figure 13:
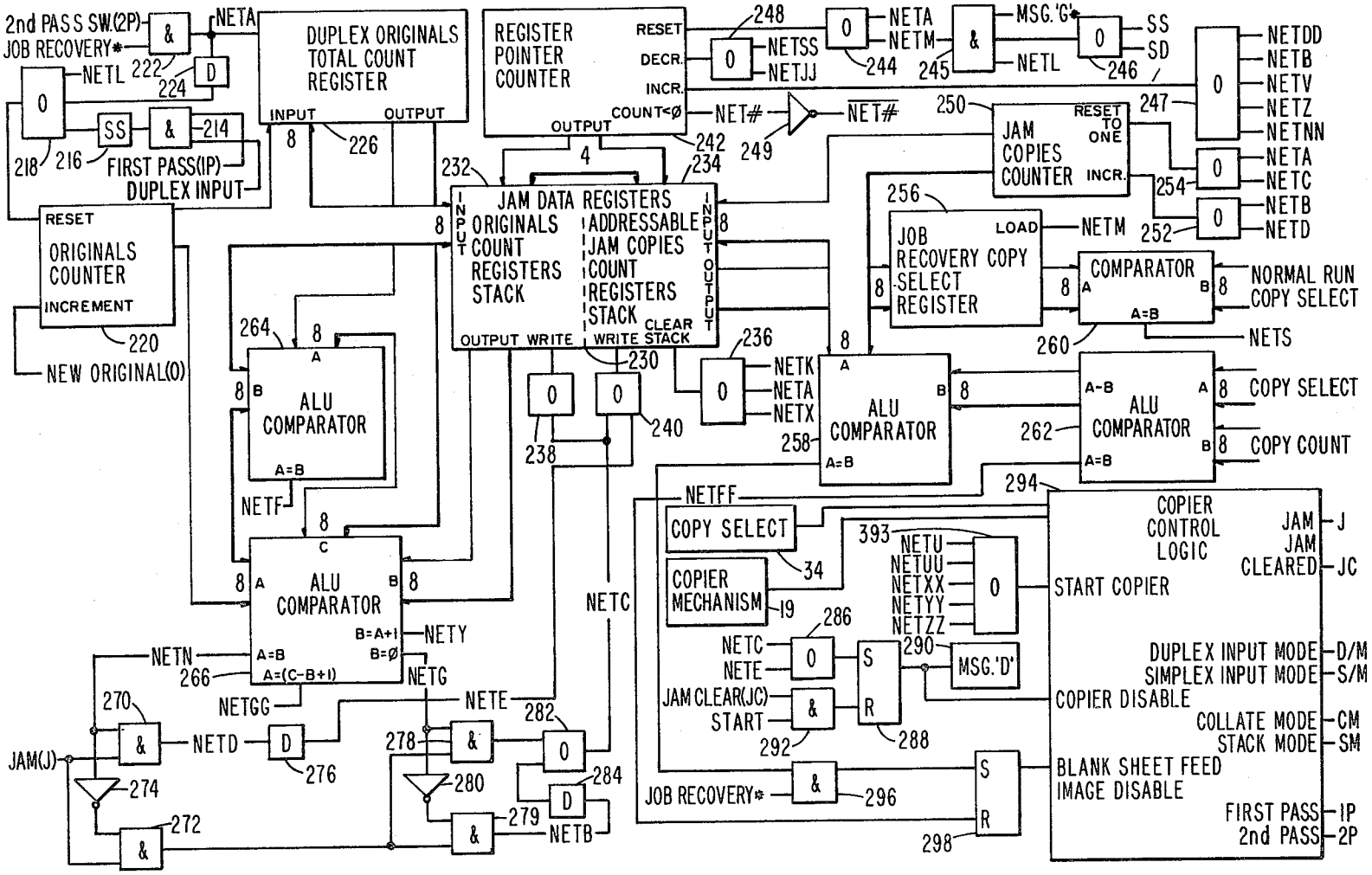
FIGS. 13 through 17 taken together form an electrical block and schematic diagram of the logic control system of this invention for effecting jam recovery.

As shown in FIG. 13, AND gate 214 is connected to single shot generator 216 the output from which is coupled through OR gate 218 to the reset input of originals counter unit 220. OR gate 218 also receives an output from AND gate 222 through delay 224 and an output from AND gate 225 (FIG. 14) for resetting of counter 220. The output from AND gate 222 is also coupled to duplex originals total count register unit 226 as a WRITE input. Register unit 226 also receives an input from originals counter 220.

Jam data storage register units 230 (FIG. 13) include an originals count register stack 232 and an addressable jam copies count register stack 234. A CLEAR input is coupled to jam data register units 230 through OR gate 236, while WRITE inputs are coupled to originals count register stack 232 and jam copies count register stack 234 through OR gates 238 and 240, respectively.

Register pointer counter unit 242 (FIG. 13) determines which registers within the two register stacks are accessible and receives a reset input from OR gate 244 one input to which is coupled from AND gate 245, which receives an input from OR gate 246. The increment input to the register pointer counter unit is coupled from OR gate 247, while the decrement input is coupled from OR gate 248. Register pointer counter unit 242 supplies outputs to the address lines of originals count register stack, or unit, 232 and the jam copies count register stack, or unit, 234 of the jam data register units 230. Register pointer counter unit 242 also supplies an output when the count 0, and a reciprocal output through inverter 249.

Jam copies counter unit 250 (FIG. 13) is incremented by an input from OR gate 252, while counter unit 250 is reset to one by an input from OR gate 254. Jam copies counter unit 250 supplies an input to jam copies count register unit 234 and to comparator 258 (designated A). Jam copies count register unit 234 supplies an input to job recovery copy select register 256.

Job recovery copy select register 256 (FIG. 13) supplies an input to comparator 260 (designated A), which also receives normal run and copy select input information (designated B) from machine control logic and provides an output to AND gate 261 (FIG. 14) when A=B. Comparator 258 receives an input (designated B) from ALU comparator 262 (which provides an A minus B output where the A input thereto is a copy select input and the B input thereto is a copy count input).

ALU comparator 264 (FIG. 13) receives an input (designated B) from originals counter unit 220 in addition to an input (designated A) from duplex originals total count register 226. ALU comparator 266 is connected to receive an input (designated C) from duplex originals total count register 226, an input (designated B) from originals count register unit 232, and an input (designated A) from originals counter unit 220.

A jam indication is coupled from machine control logic to AND gates 270 and 272 (FIG. 13), which also receive an input from ALU comparator 266 when the A input equals the B input thereto, the input to AND gate 272 being coupled through inverter 274. The output from AND gate 270 is coupled through delay 276 to OR gate 240 (and hence to the WRITE input of jam copies count register unit 234), while the output from AND gate 272 is coupled to AND gates 278 and 279 which receive a second input from ALU comparator unit 266 when the B input thereto equals 0. The input to AND gate 279 from comparator 266 is coupled through inverter 280.

The output from AND gate 278 (FIG. 13) is coupled through OR gate 282, while the output from AND gate 279 is coupled to OR gate 282 through delay 284 and through OR gate 252 to increment jam copies counter unit 250. The output from OR gate 282 is coupled through OR gate 286 to flip-flop 288 to set the flip-flop and cause a message (designated D) to be displayed at message indicator 290. Flip-flop 288 is reset by an input from AND gate 292, and when the message (designated D) is displayed, the copy machine is disabled by the Q output of flip-flop 288 coupled to copier control logic unit 294. The message designated D to be displayed to the operator indicates operational instructions to the operator to clear the jammed sheet or sheets from the copy machine and then press the START button.

When the A input equals the B input at comparator 258, an output is coupled from comparator 258 to AND gate 296 which provides an output (when job recovery is not yet selected) to set flip-flop 298 to cause image disabling and, optionally, to cause blank sheets to be fed to the copy machine collator for flagging purposes. As shown, the output of flip-flop 298 is coupled to copier control logic unit 294 to cause blank sheet feeding and also to disable imaging by the copy machine. Flip-flop 298 is reset by an output from ALU comparator 262 when the A and B inputs thereto are equal.

Figure 14:
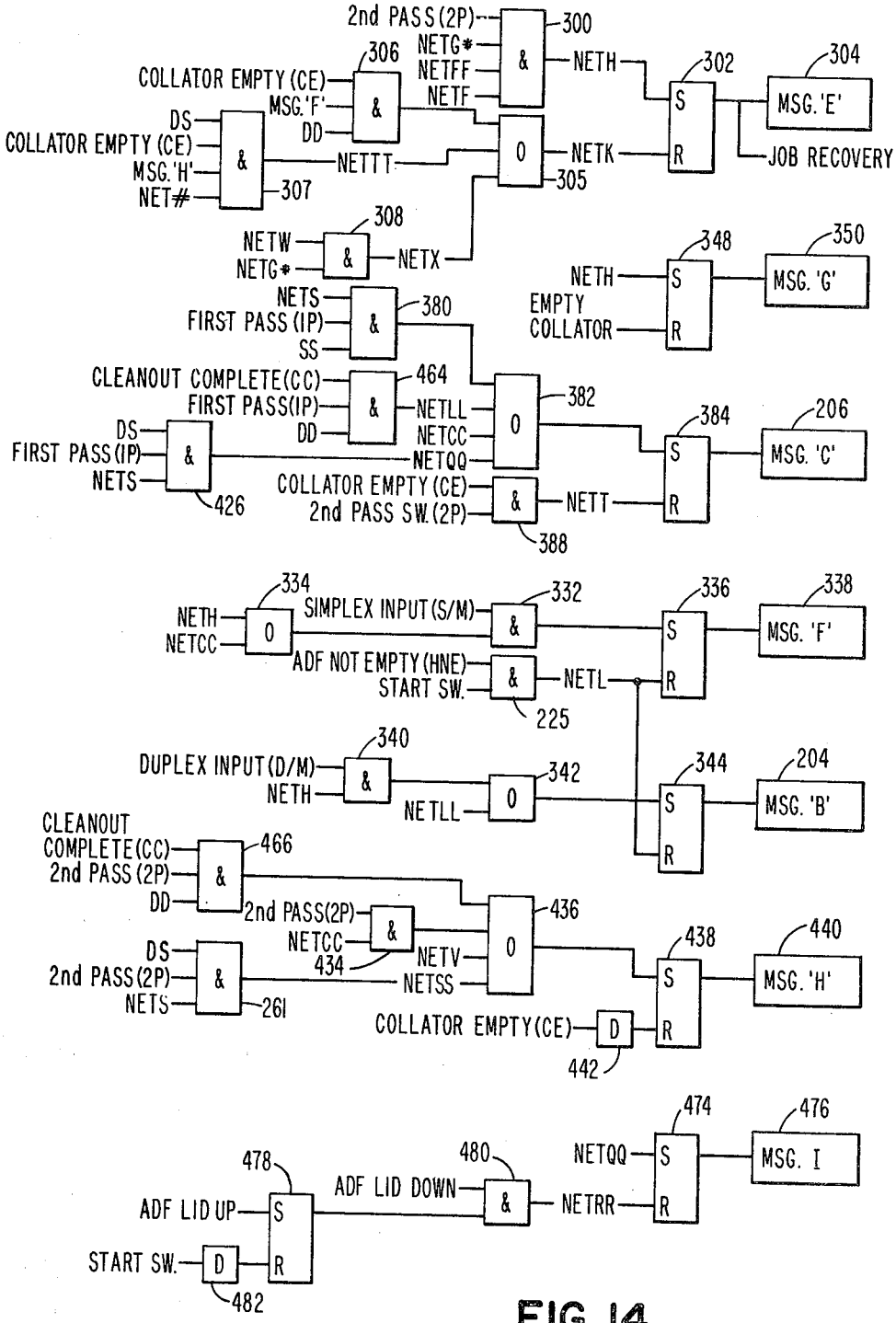

As shown in FIG. 14, AND gate 300 receives a plurality of inputs (including an indication of second pass and comparator outputs from comparators 262, 264 and 266 shown in FIG. 13) and, upon coincidence of inputs, supplies an output to flip-flop 302 to set the flip-flop and cause a message (designated E) to be displayed at indicator 304. Flip-flop 302 is reset by an output from OR gate 305 connected with AND gates 306, 307 and 308. The message designated E to be displayed to the operator indicates operational instructions for job recovery to the operator to inform the operator that the job is not yet complete, and that it is necessary to remake duplex copies jammed during second pass and to follow the instructions of all other displayed messages. The operator then will be informed that job recovery will be completed when the message is no longer displayed, and that if no jammed copies are to be remade (or if remake is to be discontinued once undertaken), the CANCEL JOB RECOVERY button should be pressed.

Figure 15:
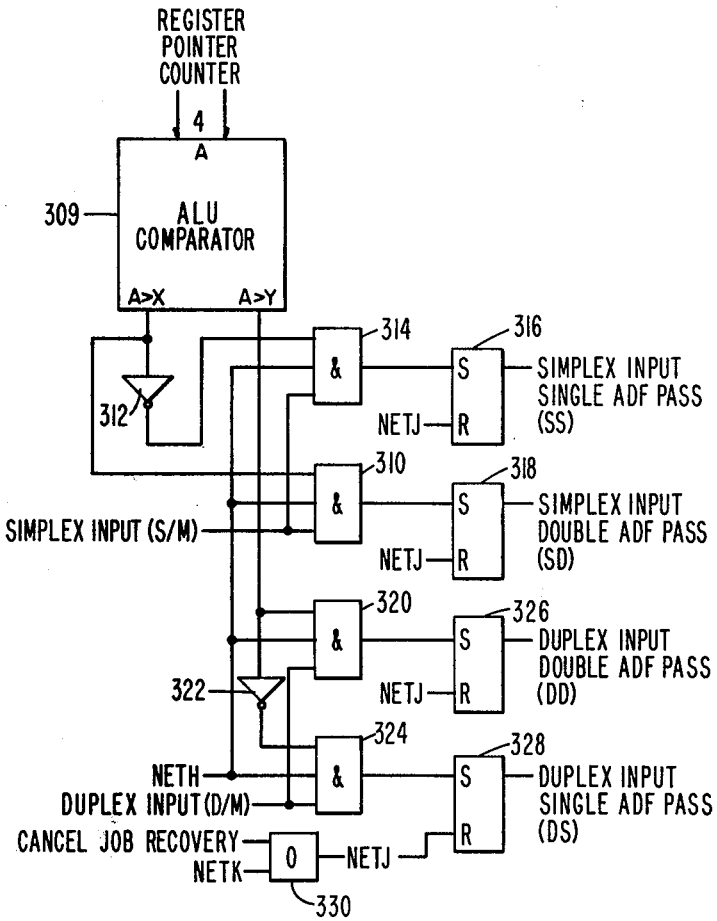

As shown in FIG. 15, Comparator 309 receives an input (designated A) from register pointer counter unit 242 (FIG. 13) and supplies an output, when A is greater than a predetermined value (X), to AND gate 310 and through inverter 312 to AND gate 314. AND gates 310 and 314 receive simplex input indications and an output from AND gate 300 (FIG. 14). The output from AND gate 314 sets flip-flop 316 which, when set, provides an output indicative that a simplex input, single ADF pass (SS) is to be made for job recovery. The output from AND gate 310 sets flip-flop 318 which, when set, provides an output indicative that a simplex input, double ADF pass (SD) is to be made for job recovery.

When the A input is greater than a predetermined value (Y), then comparator 308 provides an output to AND gate 320 and an output through inverter 322 to AND gate 324. AND gates 320 and 324 also receive an indication of duplex input and an output from AND gate 300. the output from AND gate 320 sets flip-flop 326 which, when set, provides an output indicative that a duplex input, double ADF pass (DD) is to be made for job recovery. The output from AND gate 324 sets flip-flop 328 which, when set, provides an output indicative that a duplex input, single ADF pass (DS) is to be made for job recovery. All four of these flip-flops, (i.e., flip-flops 316, 318, 326 and 328) are reset by an output from OR gate 330 when job recovery is cancelled or is completed.

With simplex inputs, a signal is coupled to AND gate 332 as shown in FIG. 14, which has a second input from OR gate 334, with the output of gate 332 setting flip-flop 336 which, when set, causes a message (designated F) to be displayed at an indicator 338. The message designated F provides operational instructions to the operator to remove the stack of originals from the ADF exit tray and place them in the ADF input hopper without flipping the stack over, and then to press the START button when all indicated instructions have been completed.

With duplex inputs, a signal is coupled to AND gate 340, as also shown in FIG. 14, which receives a second input from AND gate 300. The output of AND gate 340 is coupled through OR gate 342 to set flip-flop 344 which, when set, causes a message (designated B) to be displayed at indicator 204. The message indicated as B provides operational instructions to the operator to remove the stack of originals from the ADF exit tray, flip the stack over, place the stack in the ADF input hopper, and then press START button when all indicated instructions have been completed.

The output from AND gate 300 is also coupled to flip-flop 348 to set the flip-flop and cause a message (designated G) to be displayed at indicator 350. The message indicated as G provides operational instructions to the operator to remove the copies from collator and set them aside.

When the collator is empty, then flip-flop 348 is reset to turn off the message designated as G. When the ADF is not empty and the start switch is depressed, AND gate 225 provides an output to reset flip-flops 336 and 344 to turn off the messages designated F and B, respectively.

Figure 16:
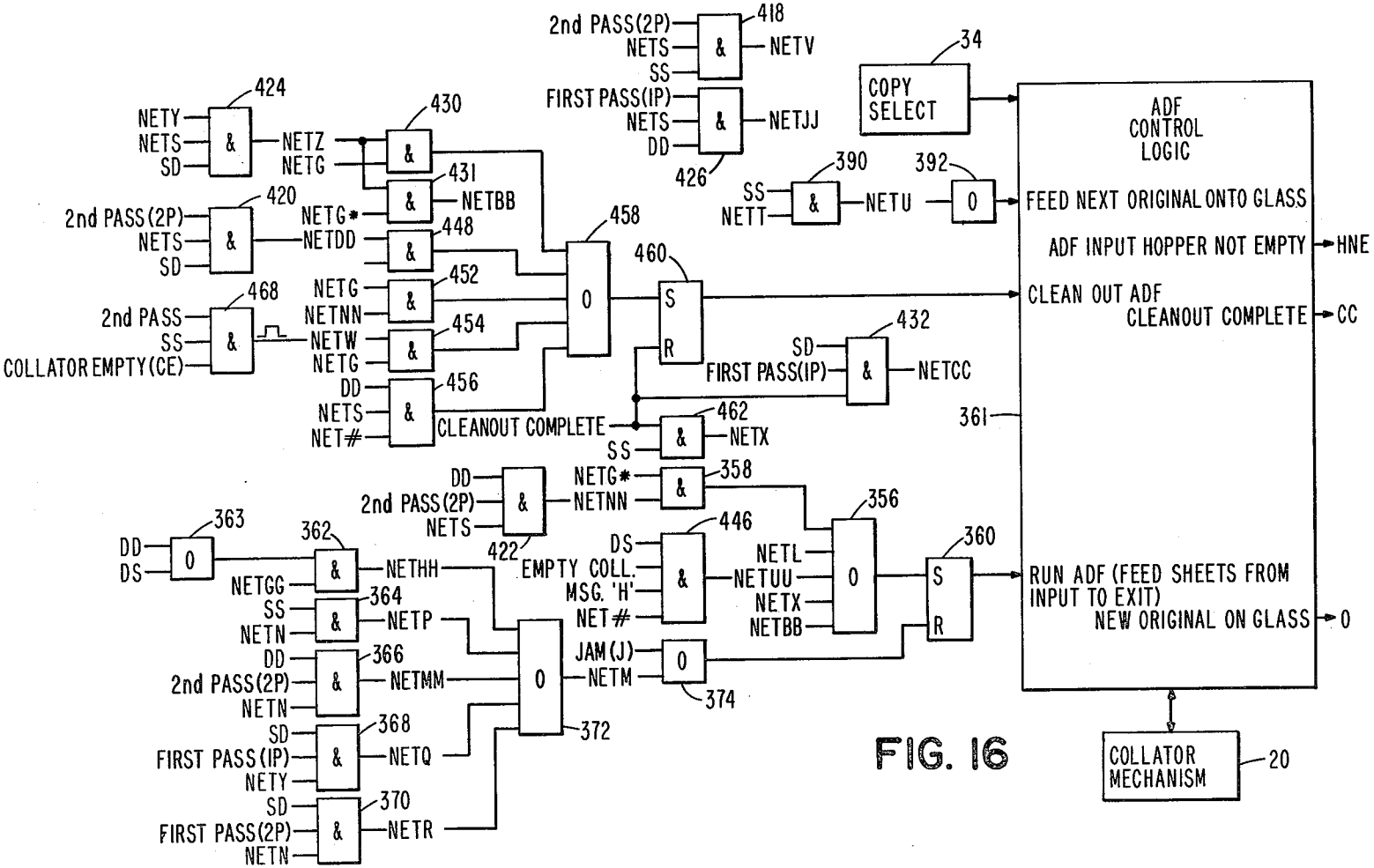

As shown in FIG. 16, OR gate 356 has a plurality of inputs including an input from AND gate 358. The output of OR gate 356 sets flip-flop 360 to cause the automatic document feed (ADF) unit to operate, and thus feed originals across the copy area to the ADF exit tray until the desired original is located for copying. As shown, the output from flip-flop 360 is coupled to ADF control logic unit 361 to cause the ADF to be run to feed sheets from the input to the exit. Flip-flop 360 is reset by a signal from any one of AND gates 362 (having an input from OR gate 363), 364, 366, 368, and 370, the output from each of which is coupled through OR gates 372 and 374, the latter of which has a jam indication as a second input to stop the ADF.

Figure 17:
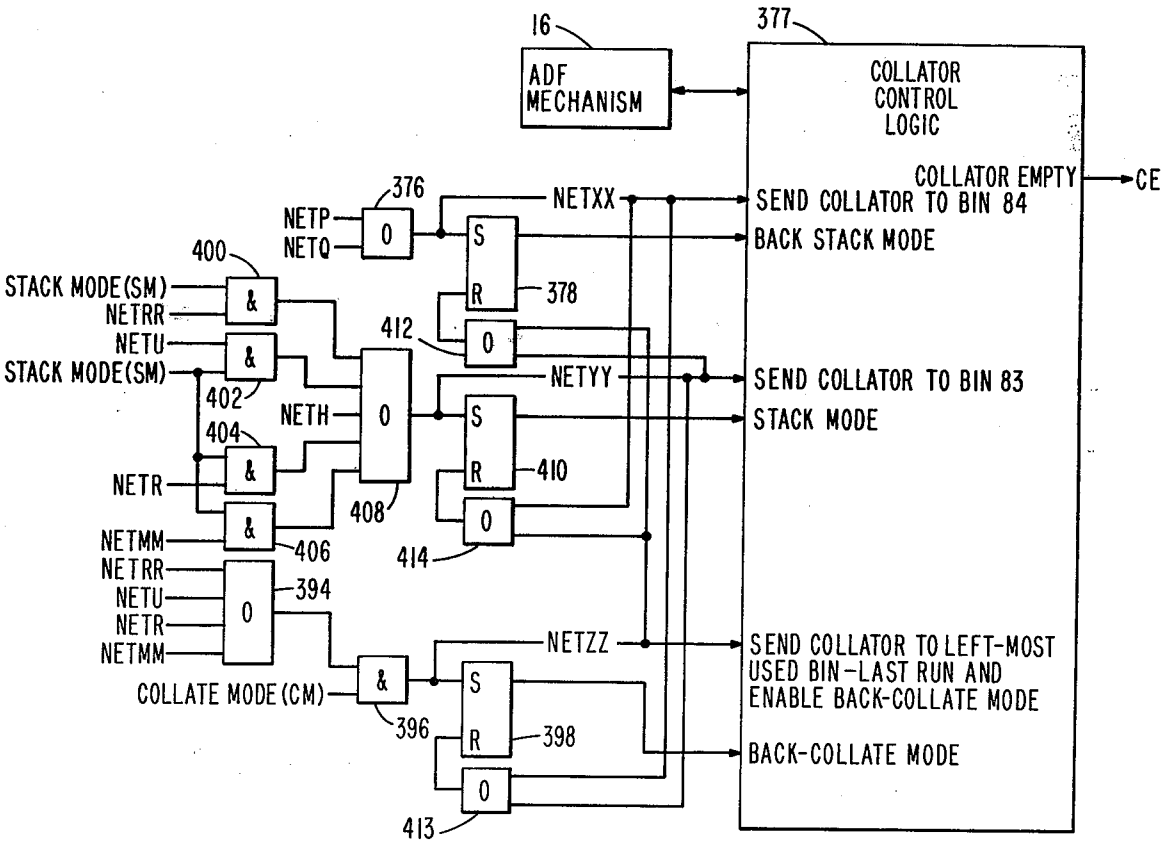

As shown in FIG. 17, OR gate 376 provides an output to send the collator to the most remote bin (bin 84). As shown, this is accomplished by connecting the output of gate 376 with collator control logic unit 377. The output from gate 376 also sets flip-flop 378 which, when set, provides output to initiate back-stacking in the collator.

As shown in FIG. 14, AND gate 380, upon coincidence of inputs, provides an output that is coupled through OR gate 382 to set flip-flop 384 which, when set, causes a message (designated C) to be displayed at indicator 206. When the collator is empty and the second pass switch is depressed, AND gate 388 provides an output to reset flip-flop 384 to cause message C to no longer be displayed.

With simplex input and single ADF pass (SS) selected and an output coupled from AND gate 388 (FIG. 14) to AND gate 390 (FIG. 16), AND gate 390 provides an output through OR gate 392 to feed the next original in the ADF input hopper, and to start the copy machine through OR gate 393 (FIG. 13).

As shown in FIG. 17, an output from OR gate 394 provides an output to AND gate 396 which upon receiving an input indicative of the collate mode, provides an output to send the collator to a preselected pseudo-home bin (i.e., the left-most bin last run) and to set flip-flop 398 which, when set, provides an output to cause the collator to operate in the back-collate mode.

As also shown in FIG. 17, for the stack mode, AND gates 400, 402, 404 and 406 are connected through OR gate 408 (along with the output of AND gate 300 as shown in FIG. 14) to set flip-flop 410 to cause the collator to be moved to the nearest bin (bin 83) and provides an output signal to cause the collator to operate in the stack mode.

In the stack mode, the nearest bin (bin 83) in the collator is filled and each adjacent rearward bin is then successively filled as is necessary. In the collate mode, successive copies of each original are inserted in different bins starting at bin 83 and extending rearwardly therefrom. In the back-stack mode, the most remote bin (bin 84) in the collator is filled and each adjacent forward bin is then successively filled as is necessary, except that the bin is changed at each change of an original being copied to generate replacement copies (copies of each original can require more than one bin in some cases). In the back-collate mode, each successive copy is inserted in different bins starting at the most remote bin (bin 84) and utilizing each adjacent forward bin therefore as are needed. Flip-flops 378, 398 and 410 are reset through OR gates 412, 413, and 414 respectively.

When the copy run is complete at various stages for the four modes of job recovery, the register pointer counter 242 (FIG. 13) is incremented through OR gate 247 by the output of AND gate 418 (FIG. 16) (for simplex input single ADF pass), AND gate 420 (FIG. 16) (for simplex input double ADF pass), AND gate 433 (FIG. 16) (for duplex input double ADF pass), AND gate 279 (FIG. 13) (for storage of jammed sheet data prior to job recovery), and AND gate 424 (FIG. 16) (for sensing completion of the first run for simplex input double ADF pass). Register pointer counter 242 (FIG. 13) is decremented through OR gate 248 by the output of AND gate 261 (FIG. 14) (for duplex input single ADF pass) and AND gate 426 (FIG. 16) (for sensing completion of first run for duplex input double ADF pass).

The output from AND gate 424 is also coupled to AND gates 430 and 431 (FIG. 16) both of which receive a second input from ALU comparator 266 (FIG. 13) depending upon whether the count at originals counter register 232 equals zero or not.

As shown in FIG. 14, during a second pass, and upon receipt of an input from AND gate 432, AND gate 434 produces an output through OR gate 436 to set flip-flop 438 which, when set, causes a message (designated H) to be displayed at indicator 440. The message designated as H provides operational instructions to the operator to remove the recovered copies then in the collator and hand-collate them into the optional blank sheet positions within the copies earlier set aside before the beginning of job recovery. Flip-flop 438 is reset, when the collator is empty, through delay 442.

When the message H is displayed, an input is provided to AND gates 307 (FIG. 14) and 446 (FIG. 16) one or the other of which gates receive an output from ALU comparator 266 (FIG. 13) depending upon whether or not the count at count register unit 232 equals zero (AND gates 307 and 446 also receive an input only when duplex input single ADF pass is selected). If all jammed copies have been recovered, the output of AND gate 307 will reset flip-flop 302 through OR gate 305, otherwise the output of AND gate 446 will restart the copier through OR gate 393 to continue the job recovery process.

As shown in FIG. 16, AND gates 430, 448, 452, 454, and 456 are connected with OR gate 458 the output of which sets flip-flop 460 which, when set, provides an output to cause the ADF to be cleaned out (i.e., to feed all originals in the input hopper through to the ADF exit tray). When clean-out is completed, a signal indicative of completion coupled to flip-flop 460, resets the flip-flop with the same signal being coupled to AND gates 432 (FIG. 16), 462 (FIG. 16), 464 (FIG. 14) and 466 (FIG. 14). AND gate 454 receives an input from AND gate 468, for example, to clean out the ADF when the count in originals count register unit 232 is equal to zero when simplex input single ADF pass is selected. If the count does not equal zero, then the output from AND gate 468 is coupled through AND gate 308 (FIG. 14) to reset flip-flop 302 for display of the message designated E.

As shown in FIG. 14, when flip-flop 474 is set by an output from AND gate 475, a message (designated I) is displayed at indicator 476. The message designated as I provides operational instructions to the operator to lift the ADF lid, flip the original on the glass over, close the ADF lid, and then press the START button when all indicated instructions have been completed. When the ADF lid is up, flip-flop 478 is set this provides an input to AND gate 480 the output of which resets flip-flop 474. Flip-flop 478 is reset by the start switch through delay 482.

Functioning of the job recovery control system is shown by the flow diagrams of FIGS. 18 through 22.

Figure 18A:
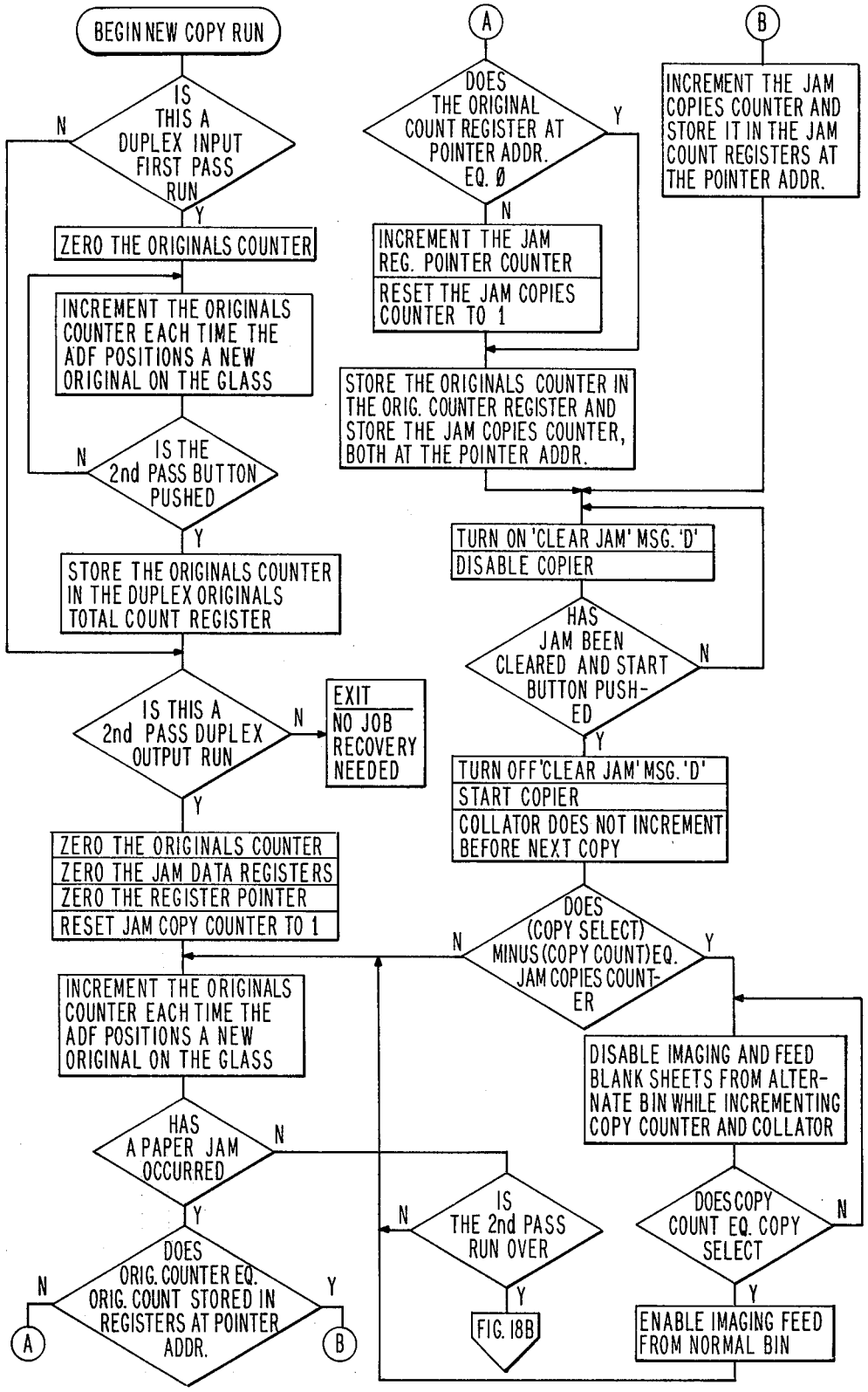
FIGS. 18A and 18B constitute a flow diagram illustrating job recovery setup for second pass jams.
Figure 18B:
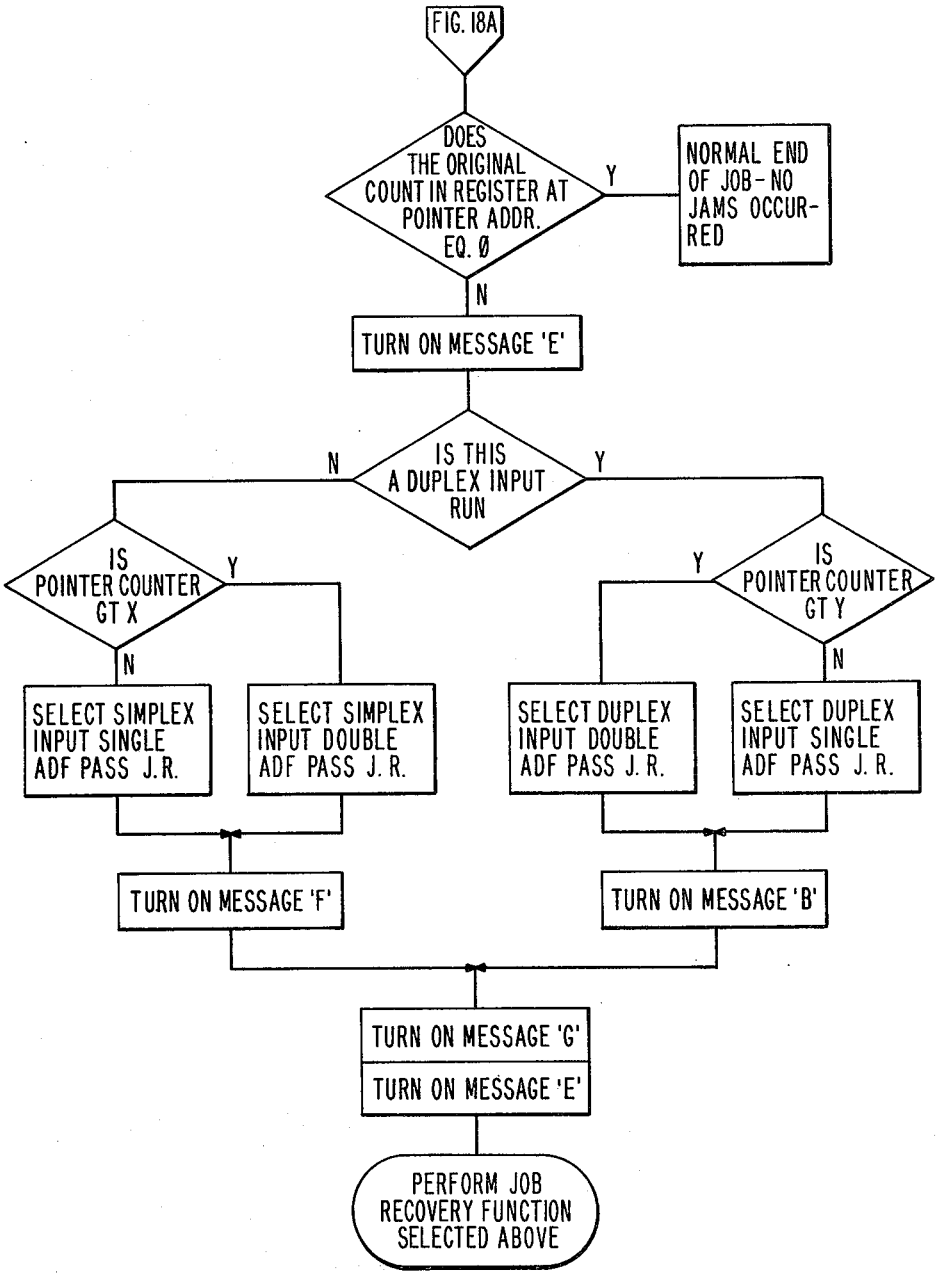

In FIGS. 18A and 18B, the flow diagram illustrates a job recovery set up for jams occurring during a second pass. As shown, at the beginning of the new copy run, a determination is made (at AND gate 214—FIG. 13) whether a duplex input first pass run is occurring. If the answer is "yes", then the originals counter unit 220 is "zeroed" (through OR gate 218) and the originals counter unit 220 is thereafter incremented each time that the ADF feeds a new original to the document glass at the copy area, and this is continued until the end of the initial run and the second pass button is depressed.

If the second pass button has been depressed and a job recovery run is not in progress (as determined by inputs to AND gate 222—FIG. 13—from the second pass switch and job recovery flip-flop 302—FIG. 14), then the count of originals counter unit 220 is stored in the duplex originals total count register unit 226. This count equals the total number of original sheets being copied and is used later during job recovery in the calculation of which originals must be recopied.

If a second pass duplex output run (not job recovery) has been initiated by the output of AND gate 222 (FIG. 13), then the originals counter 220 is "zeroed" (through OR gate 218), the jam data register units 230 are "zeroed" (register stacks 232 and 234 of units 230 are both "zeroed" through OR gate 236), the register pointer counter 242 is "zeroed" (through OR gate 244), and the jam copy counter unit 250 is reset to one (through OR gate 254).

The originals counter 220 is then incremented each time the ADF positions a new original on the glass. If no jam occurs during the second pass and the original count in the pointer counter register 242 is equal to 0, the normal job is completed.

If a copy paper jam does occur during this second pass, however, the comparators are utilized to compare the count at the originals counter unit 220 with the count stored in the originals count register unit 232. If the counts are equal, then the jam copies counter 250 is incremented (through AND gate 270 and OR gate 252) and stored in jam count register unit 234 (through delay 276 and a WRITE input through OR gate 240).

If, however, the counts are not equal, and if the count at the originals count register unit 232 does not equal zero, then the jam register pointer counter 242 is incremented through OR gate 247 (from AND gate 279 which receives inputs from AND gate 272 and comparator 266 through inverter 280), and the jam copies counter 250 is reset to 1 (through delay 284 and OR gates 282 and 254).

The count in the originals counter 220 is now stored in the originals counts register unit 232 (due to an output through either AND gate 278 or through AND gate 279 and delay 284 to OR gates 282 and 238) and the content of the jam copies counter 250 is also caused to be stored in the jam copies count register unit 234.

At this point, the "clear jam" message (the message designated as D) is displayed (through OR gate 286 and flip-flop 288—FIG. 13) and the copy machine is disabled (through copier control logic unit 294).

After the jam is cleared and the start button depressed, the "clear jam" message display is terminated (by resetting flip-flop 288 through AND gate 292) and the copy machine is again started. If the number of copies selected at the copy select minus the copy count does not equal the count at the jam copies count register unit 234 (this determination might be bypassed if desired), then the originals counter is again incremented each time the ADF positions a new original on the glass as described previously.

If the number of copies selected at the copy select minus the copy count equals the count at the jam copies count register units 234, the imaging of the copy machine is disabled and, if utilized, blank sheets are fed from the alternate bin while incrementing the copy counter and the collator (through comparator 258, AND gate 296 and flip-flop 298—FIG. 13). After this occurs, if the copy count equals the number of copies selected, then feeding of blank sheets is terminated (by resetting flip-flop 298 by an output from comparator 262) to again enable imaging and paper feed from the main, or normal, bin. The originals counter is then again incremented each time the ADF positions a new original on the document glass at the copy area in the same manner as described hereinabove.

If a copy paper jam has not then later occurred and the second pass run is completed, but the count at the original count register unit 232 does not equal zero (as it will not if a jam has occurred) (referring now to FIG. 18B), then the message designated E will be displayed (by a set input to flip-flop 302—FIG. 14) and a determination is made (at comparator 309—FIG. 15) whether the input run is a simplex input or a duplex input. If it is a simplex input run, a determination is then made as to whether the count in register pointer counter 242 (FIG. 13) (which reflects the number of originals of which recovery copies must be made) is greater than a preselected value (X) (at comparator 309). The preselected values X and Y are threshold values (number of jammed originals) for determining whether double or single ADF pass is optimum for job recovery. If not, then the simplex input single ADF pass is selected for job recovery (at AND gate 314 and flip-flop 316—FIG. 15). If register pointer counter 242 is greater than X, then a simplex input double ADF pass is selected for job recovery (at AND gate 310 and flip-flop 318—FIG. 15). In both cases, the message designated F is displayed (through AND gate 332 at flip-flop 336—FIG. 14).

If the input run is a duplex run, a determination is then made as to whether the count at register pointer counter 242 is greater than a preselected value (Y) (at comparator 309). If the value is greater, then the duplex input double ADF pass is selected for job recovery (through AND gate 320 and flip-flop 326—FIG. 15), while if not greater, then the duplex input single ADF pass is selected for job recovery (through AND gate 324 and flip-flop 328—FIG. 15). In either case, the message (designated B) is displayed (through AND gate 340, OR gate 342 and flip-flop 344—FIG. 14). In all cases, the messages (designated E and G) are also displayed (through flip-flops 302 and 348, respectively—FIG. 14). From this point, recovery follows the one mode selected by flip-flops 316, 318, 326 or 328 (FIG. 15).

A single or double pass of originals is thus dependent upon the number of jams with the number of passes being selected to make job recovery as fast as possible with a minimum of handling of originals and copies. The value of X is arbitrarily chosen for determining single or double pass for simplex originals at a value greater than one (two or three, for example) so that a single pass is effected below the chosen value of X and a double pass is effective thereabove. For a double pass, there is no necessity of replacing the copies in the tray after generation of replacement copies for each jam occurrence. The value of Y is chosen in the same manner for duplex copies. X and Y can be equal, but can also be different values.

Figure 19A:
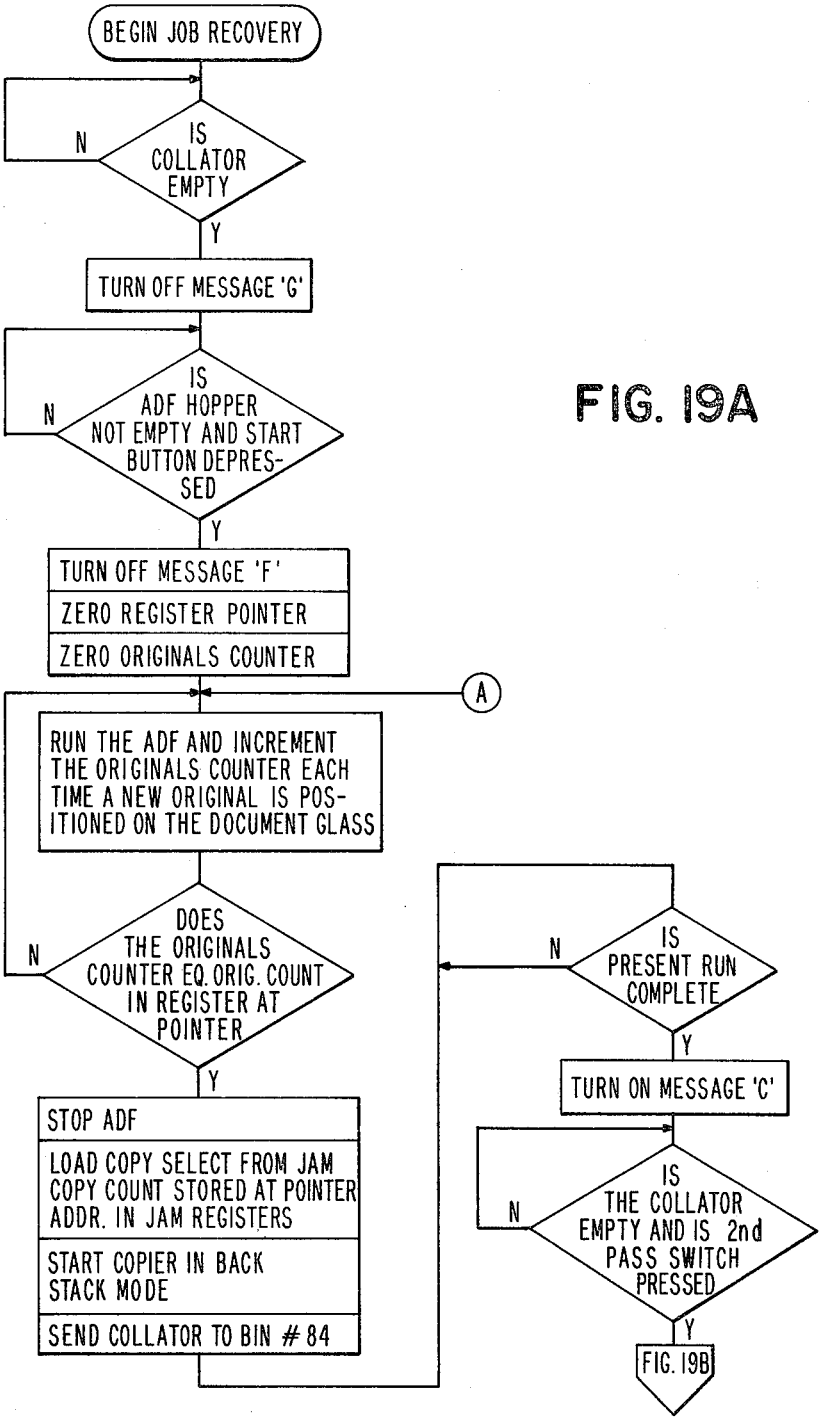
FIGS. 19A and 19B constitute a flow diagram illustrating jam recovery for simplex originals with a single document pass.
Figure 19B:
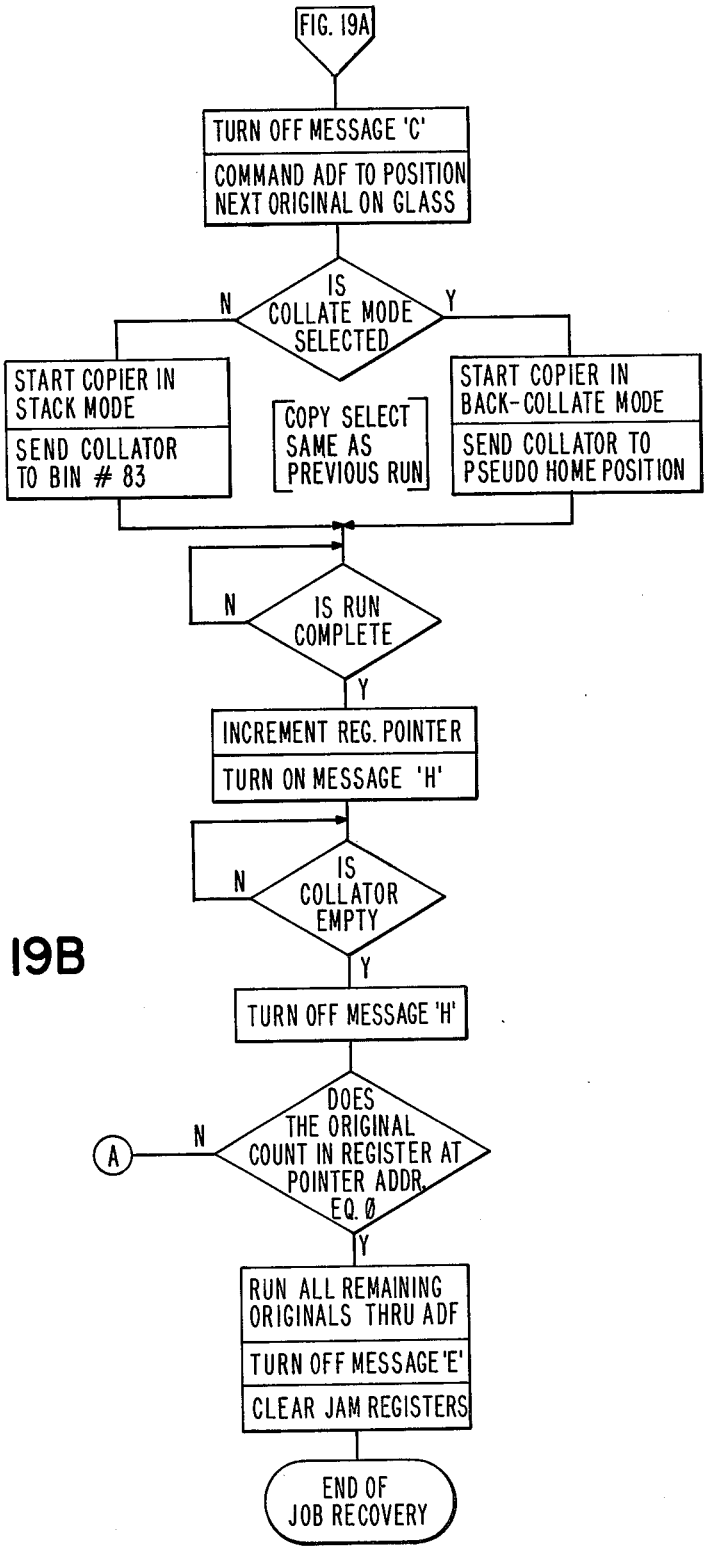

If simplex input single ADF pass has been selected, job recovery is shown by the flow diagram of FIGS. 19A and 19B. As shown, job recovery begins when the collator is empty. At this time, the display of the message designated G is terminated (by resetting flip-flop 348—FIG. 14). If the ADF input hopper is not empty and the start button is depressed, then the display of the message designated F is terminated (by resetting flip-flop 336—FIG. 14), the register pointer counter 242 is "zeroed" (through OR gate 244 and AND gate 245—FIG. 13), and the originals counter 220 is "zeroed" (through OR gate 218—FIG. 13).

The ADF is then run to feed successive originals to the copy area and subsequently to the ADF exit tray (through OR gate 356, flip-flop 360 and ADF control logic unit 361—FIG. 16), with the originals counter being incremented each time a new original is positioned on the glass platen. If the count at originals counter 220 does not equal the count at the originals count register unit 232 (at comparator 266—FIG. 13) the ADF run is continued and the originals counter 220 is incremented. If the counts above are equal, the ADF is stopped (through AND gate 364, OR gates 372 and 374 and flip-flop 360—FIG. 16), the job recovery copy select register is loaded with the number of recovery copies required from the jam copy count stored at the addressed jam count register unit 234 (at job recovery copy select register 256—FIG. 13), the copy machine is started in the back-stack mode (through OR gate 376 and flip-flop 378—FIG. 17), and the collator is sent to most remote bin (bin 84) (through OR gate 376 and collator control logic unit 377—FIG. 17).

If the run is then sensed to be complete (at AND gate 380—FIG. 14), the message designated C is displayed (through OR gate 382 and flip-flop 384). If the collator is then empty and the second pass switch is depressed (at AND gate 388), the display of message C is terminated (referring to FIG. 19B) (by resetting flip-flop 384) and the ADF positions the next original on the glass platen (through AND gate 390, OR gate 392 and ADF control logic unit 361—FIG. 16).

If the collate mode is selected, then the copy machine is started (through OR gate 393 and copier control logic unit 294—FIG. 13) in the back-collate mode (through AND gate 396 and flip-flop 398—FIG. 17) and the collator is sent to the leftmost bin used during collation of the job being recovered, i.e., the pseudo home position (through AND gate 396). If the collate mode is not selected, then the copy machine is started (through OR gate 393 and copier control logic unit 294—FIG. 13) in the stack mode (through AND gate 402 and flip-flop 410—FIG. 17) and the collator is sent to the nearest bin (bin 83) (through OR gate 408).

When the run is sensed to be complete (at AND gate 418—FIG. 16), the register pointer counter 242 (FIG. 13) is incremented (through OR gate 247—FIG. 13) and the message (designated H) is displayed (through OR gate 436 and flip-flop 438—FIG. 14).

When the collator is then sensed to be empty, message H is terminated (by reset of flip-flop 438). If the count at the originals count register unit 232 does not equal zero, then the ADF is run and the originals counter incremented by positioning of the originals as described hereinabove (by an output from comparator 266—FIG. 13). If the count does equal zero, then all of the remaining originals are caused to be run through the ADF (by an output through AND gate 454, OR gate 458 and flip-flop 460—FIG. 16), the display of the message (designated E) is terminated (through OR gate 305 and flip-flop 302—FIG. 14), and the jam data register stack units 230 are cleared (through OR gate 236—FIG. 13). This is the end of the job recovery for the simplex input single ADF pass.

Figure 20:
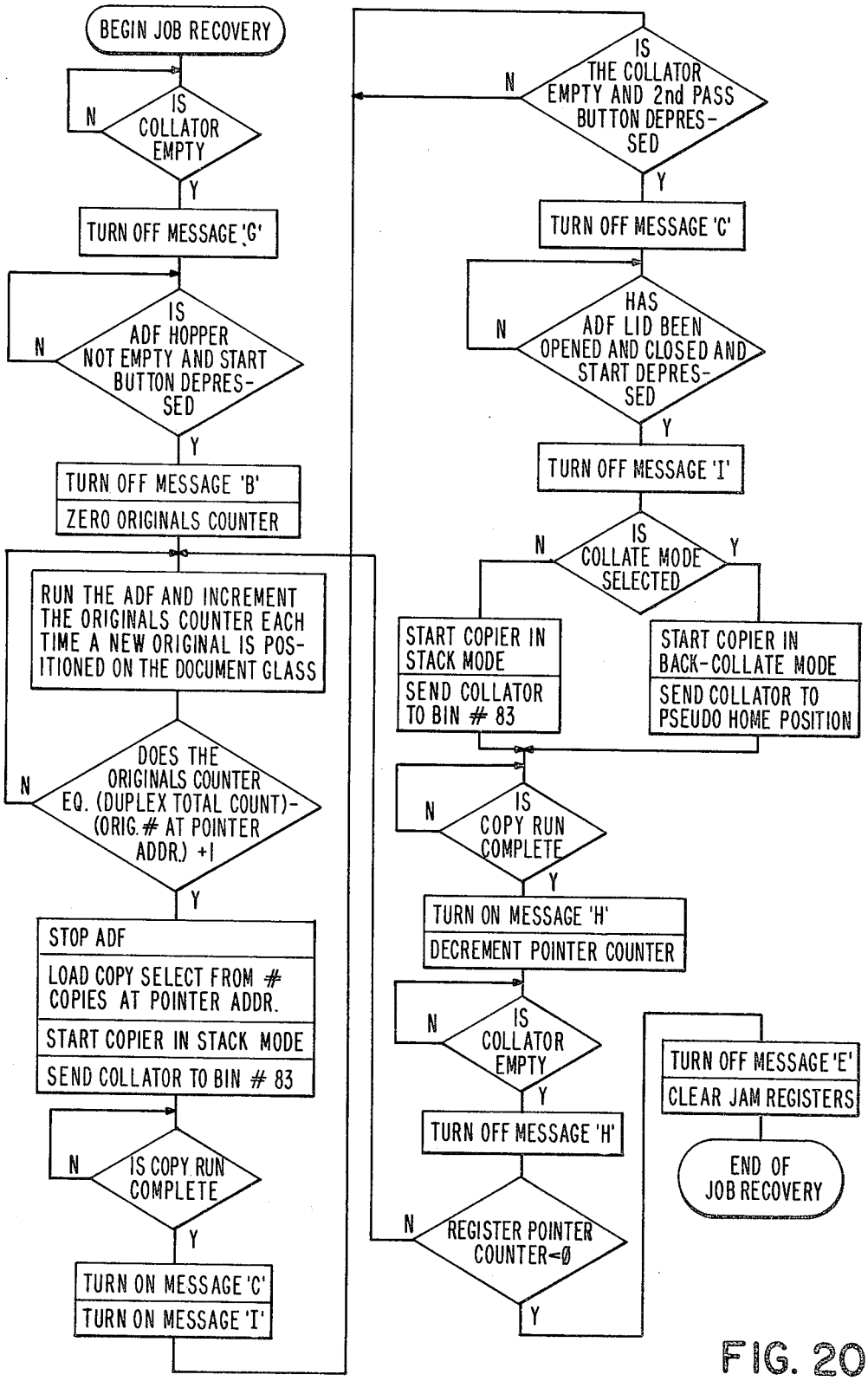
FIG. 20 is a flow diagram illustrating jam recovery for duplex originals with a single document pass.

If a duplex input single ADF pass is selected for job recovery, the flow diagram is shown in FIG. 20. As shown, when job recovery begins, if the collator is empty, the display of the message designated G is terminated (by resetting flip-flop 348—FIG. 14). If the ADF is not empty and the start button depressed, the display of the message designated B is terminated (by resetting flip-flop 344—FIG. 14).

At this time, the originals counter 220 (FIG. 13) is zeroed (through OR gate 218). The ADF is then run (through OR gate 356, flip-flop 360 and ADF control logic unit 361—FIG. 16) and the originals counter 220 is incremented each time that a new original is positioned on the glass platen.

If the count at originals counter 220 equals the count on the duplex originals total count register 226 minus the count at originals count register 232 plus one (at comparator 266—FIG. 13), then the ADF is stopped (through AND gate 362, OR gates 372 and 374, and flip-flop 360—FIG. 16) and the job recovery copy select register 256 is loaded from the number of copies recorded in the addressed jam copies count register 234 (through an output from OR gate 372). In addition, the copy machine is started in the stack mode (through OR gate 408 and flip-flop 410—FIG. 17) and the collator is sent to the nearest bin (bin 83) (through OR gate 408).

When the copy run is sensed to be complete (at AND gate 475—FIG. 14), the messages designated C and I are displayed (through OR gate 382 and flip-flops 384 and 474). When the collator is empty and the second pass switch is depressed, the display of message C is terminated (by resetting flip-flop 384 through AND gate 388). When the ADF lid has been opened and then closed and the start switch depressed, the display of message I is terminated (by resetting flip-flop 474 from an output from flip-flop 478 through AND gate 480).

If the collate mode has not been selected, then the copy machine is started in the stack mode (at AND gate 404, OR gate 408, flip-flop 410 and collator control logic unit 377—FIG. 17) and the collator is sent to the nearest bin (bin 83) (through OR gate 408). If the collate mode has been selected, however, the copy machine is started in the back-collate mode (through OR gate 394, and gate 396, flip-flop 398 and collator control logic unit 377) and the collator is sent to the left-most bin used during collation of the job being recovered, i.e., the pseudo home position (through AND gate 396).

When a determination is made that the copy run is complete (at AND gate 261—FIG. 14), the message designated H is displayed (through OR gate 436 and flip-flop 438) and the register pointer counter 242 is decremented (through OR gate 248—FIG. 13).

When the collator is empty, the display of the message designated H is terminated (by resetting flip-flop 438 through delay 442). If the original number at originals count register 232 is not $<0$, then the ADF is run and the originals counter is incremented each time a new original is positioned on the glass platen in the same manner as described hereinabove. If the number is $<0$, then the display of the message designated E is terminated (through OR gate 305 and flip-flop 302) and the jam data register units 230 are cleared (through OR gate 236—FIG. 13). This is the end of job recovery for the duplex input single ADF pass.

Figure 21A:
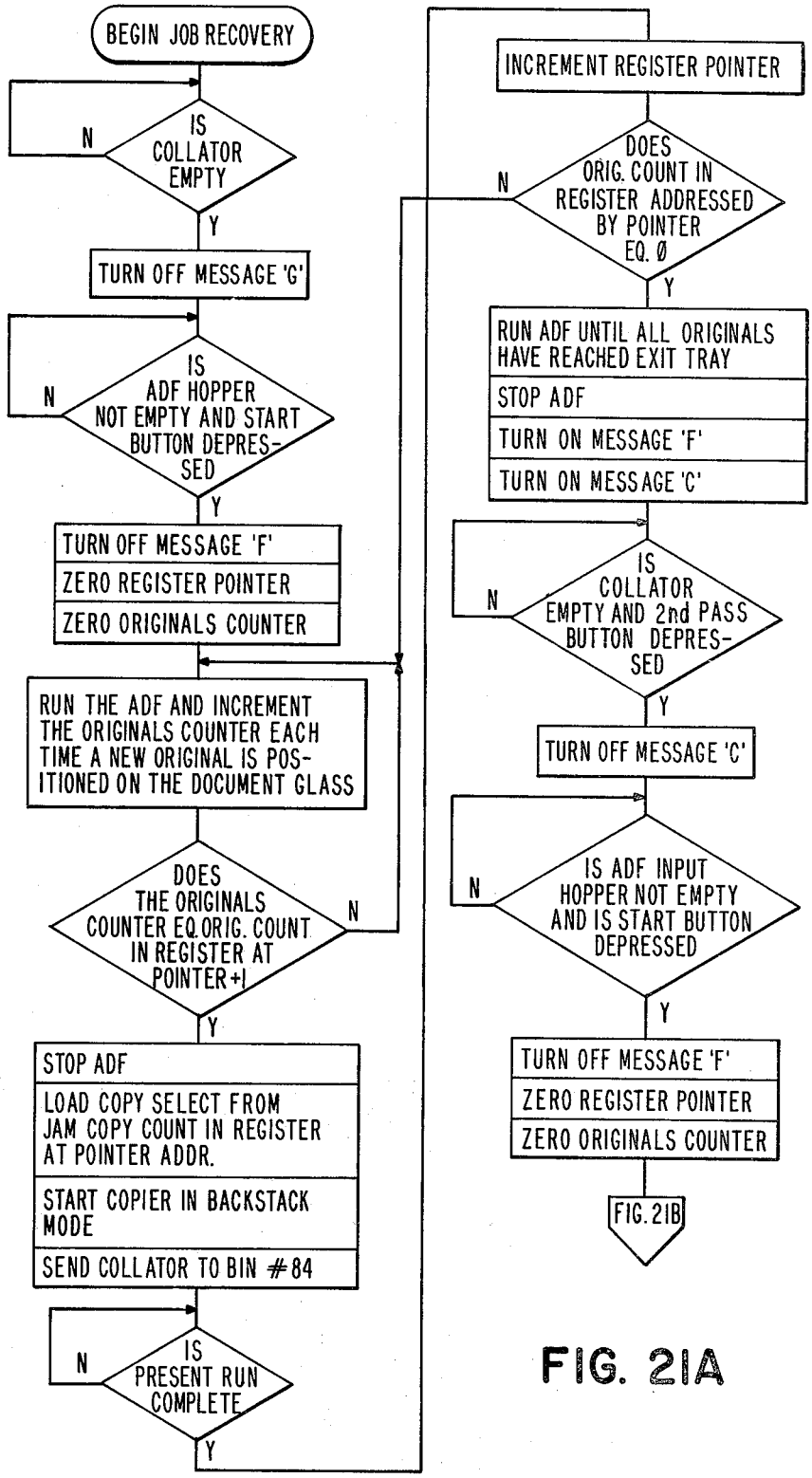
FIGS. 21A and 21B constitute a flow diagram illustrating jam recovery for simplex originals with a double document pass.
Figure 21B:
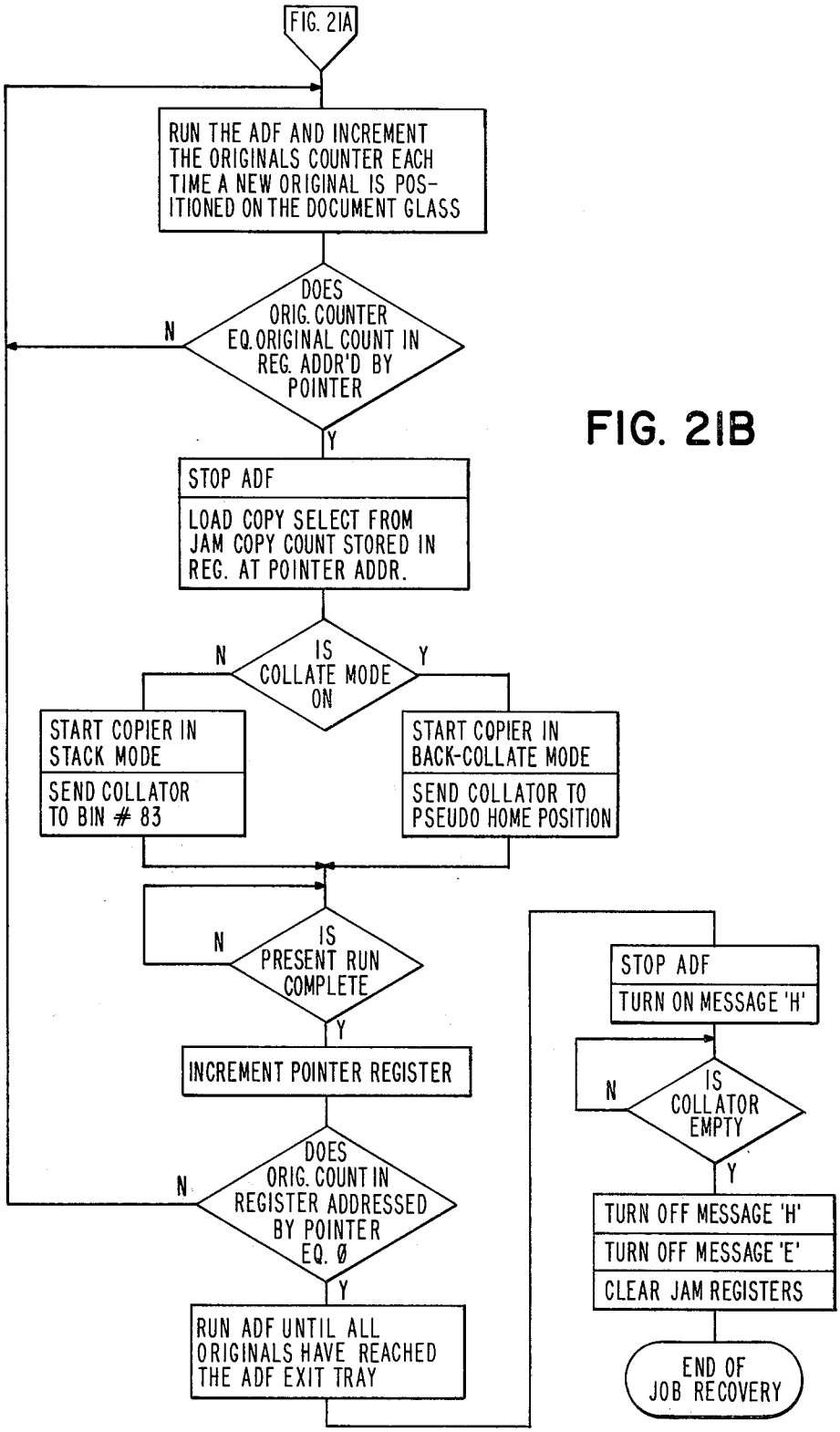

If a simplex input double ADF pass has been selected, for job recovery, the flow diagram is shown in FIGS. 21A and 21B. As shown, job recovery is begun and, if the collator is empty, the display of the message designated G is terminated (by resetting flip-flop 348—FIG. 14). If the ADF input hopper is not empty and the start button has been depressed, then the display of the message designated F is terminated (by resetting flip-flop 336—FIG. 14), the register pointer counter 242 is "zeroed" (through OR gate 244 and AND gate 245—FIG. 13), and the originals counter 220 is "zeroed" (through OR gate 218—FIG. 13). The ADF is then run (through OR gate 356, flip-flop 360 and ADF control logi unit 361—FIG. 16) and the originals counter 220 incremented each time a new original is positioned on the document glass platen.

When the count at originals counter 220 equals the original count in the originals count register 232 plus 1, (at comparator 266—FIG. 13), then the ADF is stopped (through AND gate 368, OR gates 372 and 374 and flip-flop 360—FIG. 16), the copy select is loaded from addressed jam copy count register in register stack 234 (FIG. 13), the copy machine is started in the back-stack mode (through OR gate 376, flip-flop 378 and collator control logic unit 377—FIG. 17), and the collator carriage is sent to the most remote bin (bin 84) (through OR gate 376).

When the run is sensed to be complete (at AND gate 424—FIG. 16), the register pointer counter 242 is then incremented (through OR gate 247—FIG. 13). If the count at originals count register 232 equals zero, then the ADF is run until all originals have reached the exit tray (through OR gate 458, flip-flop 460 and ADF control logic unit 361—FIG. 16). The ADF is then stopped, automatically, and the messages designated F and C are displayed (through AND gate 332, OR gate 334, and flip-flop 336, and through OR gate 382 and flip-flop 384—FIG. 14).

When the collator is sensed to be empty and the second pass button has been depressed (at AND gate 388—FIG. 14), display of the message designated C is terminated (by resetting flip-flop 384). If the ADF input hopper is not empty and the start button has been depressed (as sensed at AND gate 225—FIG. 14), then the display of the message designated F is terminated (by resetting flip-flop 336), the register pointer counter 242 is zeroed (through OR gate 244 and AND gate 245—FIG. 13), and the originals counter 220 is zeroed (through OR gate 218—FIG. 13).

Referring to FIG. 21B, the ADF is then run and the originals counter 220 is incremented each time a new original is positioned on the glass platen (through OR gate 356, flip-flop 360 and ADF control logic unit 361—FIG. 16). When the count at originals counter 220 equals the count in the originals register 232, then the ADF is stopped (by resetting flip-flop 360—FIG. 16) and the job recovery copy select 256 is loaded from the jam copy count stored in the addressed jam copy count register 234 (by an output from OR gate 372).

A determination is then made as to whether the collate mode has been selected. If not, the copy machine is started in the stack mode and the collator is sent to the nearest bin (bin 83) (through OR gate 408 and flip-flop 410—FIG. 17). If the collate mode is selected, then the copy machine is started in the back-collate mode and the collator is sent to the left-most bin used during collation of the run being recovered, i.e., the pseudo home position (through AND gate 396 and flip-flop 398—FIG. 17).

When the present run is complete, the pointer register counter 242 is incremented (through OR gate 247—FIG. 13). If the original count in register 232 does not equal zero, then the ADF is run and the originals counter incremented as described hereinabove. If the count does not equal zero, then the ADF is run until all of the originals have reached the ADF exit tray (through OR gate 356, flip-flop 360 and ADF control logic unit 361—FIG. 16), the ADF is automatically stopped, and the message designated H is displayed (through AND gate 434, OR gate 436, and flip-flop 438—FIG. 14).

A determination is then made as to whether the collator is empty, and if it is empty, then the display of the messages H and E are terminated (by resetting flip-flops 438 and 302, respectively), and the jam register units 230 are cleared (through OR gate 236—FIG. 13). This completes job recovery for the simplex input double ADF pass.

Figure 22A:
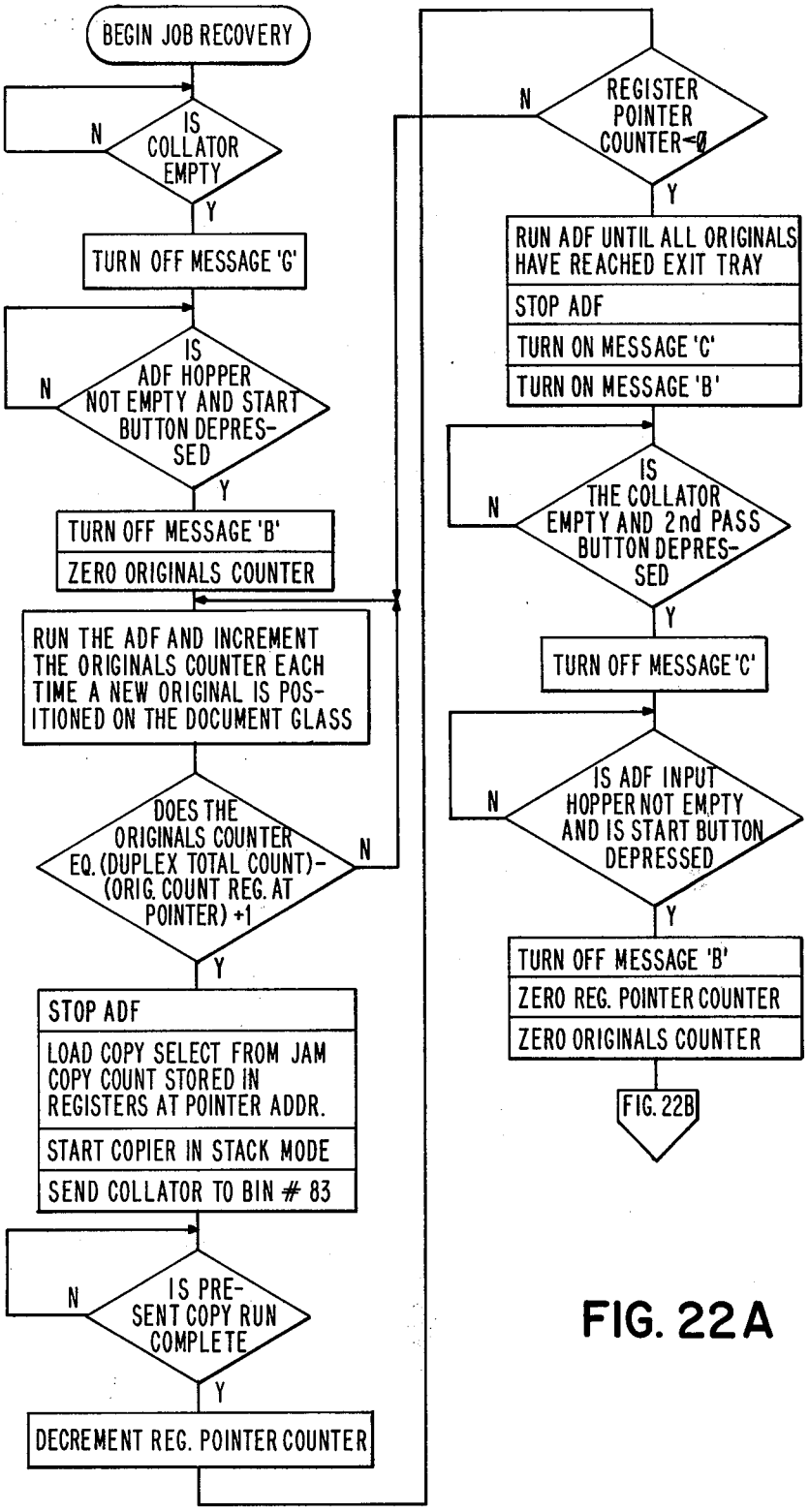
FIGS. 22A and 22B constitute a flow diagram illustrating jam recovery for duplex originals with a double document pass.
Figure 22B:
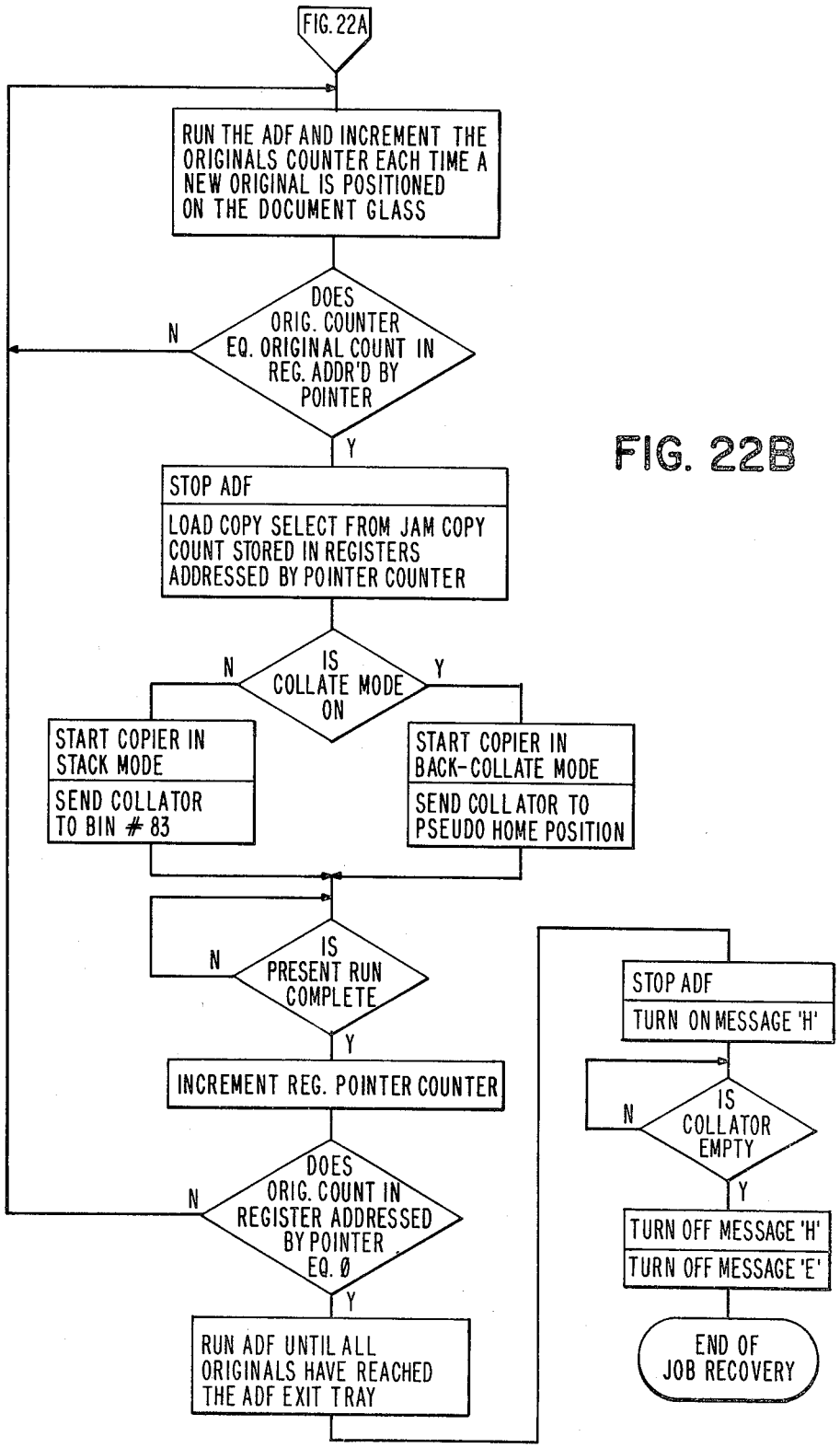

If a duplex input double ADF pass is selected for job recovery, the flow diagram is shown in FIGS. 22A and 22B. As shown, job recovery is begun and a determination is made as to whether the collator is empty. If it is, then the display of the message designated G is terminated (by resetting flip-flop 348—FIG. 14). If the ADF input hopper is not empty and the start button is depressed (as is determined at AND gate 225), display of the message designated B is terminated (by resetting flip-flop 344), and the originals counter 220 is "zeroed" (through OR gate 218—FIG. 13).

The ADF is then run (through OR gate 356, flip-flop 360, and ADF control logic unit 361—FIG. 16) and the originals counter 220 is incremented each time a new original is positioned on the document glass platen. A determination is then made (at comparator 266—FIG. 13) as to whether the count at the originals counter equals the duplex total count plus 1 at register 226. If it does, then the ADF is stopped (through OR gate 372, AND gate 356 and resetting of flip-flop 360—FIG. 16), the copy select is loaded from the jam copy count stored in the addressed register in stack 234 (FIG. 13), the copy machine is started in the stack mode (through OR gate 408, flip-flop 410 and collator control logic unit 377—FIG. 17), and the collator is sent to the nearest bin (bin 83) (through OR gate 408).

If the present copy run is sensed to be complete (at AND gate 426—FIG. 16), then the register pointer counter 242 is decremented (through OR gate 248—FIG. 13). If the count on the originals count register 232 is not then $<0$, the ADF is run and the originals counter incremented as described hereinabove.

If the count is $<0$, then the ADF is run until all of the originals reach the exit tray (through OR gate 458, AND gate 456, flip-flop 460 and ADF control logic unit 361—FIG. 16), after which the ADF is stopped (by resetting flip-flop 460), and the messages designated C and B are displayed (through OR gate 382, AND gate 464, and flip-flop 384, and through OR gate 342 and flip-flop 344—FIG. 14).

When the collator is sensed to be empty and the second pass button is depressed (at AND gate 388), the display of the message designated C is terminated (by resetting flip-flop 384). If the ADF input hopper is not empty and the start button has been depressed (sensed at AND gate 225), the display of the message designated B is terminated (by resetting flip-flop 344). In addition, the register pointer counter 242 is "zeroed" (through AND gate 245 and OR gates 244 and 246—FIG. 13) and the originals counter 220 is "zeroed" (through OR gate 218).

Referring now to FIG. 22B, the ADF is then run (through OR gate 356, flip-flop 360 and ADF control logic unit 361—FIG. 16) and the originals counter 220 is incremented each time a new original is placed on the document glass platen. A determination is then made (at comparator 266—FIG. 13) as to whether the count in the originals counter equals the counter in the addressed originals count register within register stack 232. If so, then the ADF is stopped (by resetting flip-flop 360 through OR gates 372 and 374—FIG. 16) and the job recovery copy select register is loaded from the jam copies count register 234 (FIG. 13).

A determination is then made whether the collator mode is selected. If so, the copy machine is started in the back-collate mode (through AND gate 396, flip-flop 398 and collator control logic unit 377—FIG. 17) and the collator is sent to the left-most bin used during collation of the run being recovered, i.e., the pseudo home position (through AND gate 396). If the collator mode is not selected, then the copy machine is started in the stack mode (through OR gate 408, flip-flop 410 and collator control logic unit 377) and the collator is sent to the nearest bin (bin 83) (through OR gate 408).

A determination is then made (at AND gate 422 FIG. 16) as to whether the present run is complete. If so, the register pointer counter 242 is incremented (through OR gate 247—FIG. 13) and a determination is made as to whether the addressed original count in register stack 232 equals zero. If not, then the ADF is run and the originals counter incremented in the same manner as described hereinabove. If the count does equal zero, then the ADF is run until all the originals have reached the exit tray (through AND gate 452, OR gate 458, flip-flop 460 and ADF control logic unit 361—FIG. 16) after which the ADF is stopped (by resetting flip-flop 460) and the message designated H is displayed (through AND gate 438 and OR gate 436—FIG. 14).

When the collator is sensed to be empty, the display of the messages designated H and E are terminated (by resetting flip-flop 438 through delay 442 and flip-flop 302 through AND gate 306—FIG. 14). This completes job recovery for the duplex input double ADF pass.

In operation, job recovery, while copying side one of either a duplex or simplex original, can be effected during the run before second side copying is commenced. Job recovery could, however, be carried out, for jams occurring during copying of side one, in the same manner as described with respect to job recovery for jams occurring during copying of side two with the addition of similar logic circuitry. It has been found preferable, however, to carry out job recovery during the run while copying side one.

For job recovery while copying the second side with simplex originals, recovery is simple so long as the jams occurs on only one original. At the moment the jam is detected, the copy machine stops and the operator clears the jam. After the copy machine has been cleared and the drawer closed, the operator is instructed, by the display at the copy machine, to recover the jammed copy at the end of the run. The copy machine is then restarted and the position of the jammed copy or copies may be flagged (if utilized) by the copy machine picking a blank sheet from the alternate bin and collating such sheet in the position of the copy that was jammed.

At the end of the normal run, the operator removes the incomplete job from the collator, depresses the jam recovery button 42, and replaces the stack of originals back into the ADF input tray. The copy machine remembers the position of the original corresponding to jammed copies, and the ADF sorts through the stack of originals until it comes to the original just before the one where the copy jam occurred (this is side one). The copy machine makes the preselected number of copies of side one and places them in the collator. The operator then removes the copies in the collator and puts them face down in the drawer. After closing the drawer, the ADF of the copy machine places the next original on the glass platen and makes the same number of copies that were made previous to opening the drawer (this is side two). The machine places the duplex copies in the same collator bins from which the complete collated sets were removed and now it is the job of the operator to self-collate. Self-collating is further simplified where flagging sheets have been used because the operator knows which stack has missing copy or copies by finding the blank sheet inserted during the normal run to flag the missing copy or copies.

Job recovery from multiple simplex originals of side two require an extra step from that described hereinabove. In this type of recovery, the above procedure can be followed, except that the operator must replace the originals in the ADF twice to fully recover. At the end of the normal run, the operator will clear the collator of all copies, depress the job recovery button, and place the originals back in the ADF tray. The copy machine will sort through side one of the originals of the associated jam copies. Now the copy machine will make the preselected number of copies of each side when necessary and place them in the collator beginning with the furthest bin decrementing to the nearest bin. The copies will be placed face down into the drawer, and the originals are again placed into the ADF entry tray. The remainder of the job recovery is then carried out as described hereinabove.

For jam recovery while copying the second side of duplex originals, the procedure for duplexing from duplex originals is the same as duplexing from simplex originals, except that when the copy machine is ready to copy side two, the operator must turn the originals over before placing them back in the ADF entry tray for the second time (unless, of course, an inverting ADF is used to automatically accomplish the same end).

Duplexing from duplex originals is effected by depressing the button for duplexing with duplex originals. The ADF feeds each original and the programmed number of copies are made and placed in the collator. Once the ADF has duplexed a stack in the ADF input hopper, the copy machine will stop and the operator is informed that side one has been made and the machine is ready for side two or the machine may wait for the operator to depress the second pass button before second side copying is commenced. At this point, the operator takes the stack of originals from the ADF exit tray, turns it over (unless an inverting ADF is used), so that the previous copy is on the bottom, and places it back into the ADF entry tray. Now the copy machine proceeds to make side two copies and collate them.

If a jam occurs on side two, then the copy machine will stop and the operator must clear the jam. Once the jam is cleared, the operator will be instructed to recover the jammed copies at the end of the normal run. The machine is restarted and the position of the missing copies may be flagged (if utilized) by picking a blank sheet from the alternate bin.

After the machine finishes the normal run, job recovery is accomplished in the same manner. The copies are taken from the collator, the job recovery button is depressed, and the originals are taken from the ADF exit tray, turned over (unless an inverting ADF is used), and placed in the ADF entry tray. The ADF sorts through the originals making copies of the jammed side one copies and places them in the collator. After the HDF entry tray is empty, the machine stops and the operator is instructed to remove the originals, turn them over (unless an inverting ADF is used), and again place them into the ADF entry tray. The copy machine then copies side two and places the copies in the bins that were previously missing these copies. The operator then hand-collates the copies by inserting the last made sheets in the proper position in the copy stack made during the normal run (which includes replacing the blank sheets with the last made copies if flagging sheets are utilized).

Thus, as can be appreciated from the foregoing, this invention provides an improved apparatus and method for job recovery in a copying machine.

It should also be understood that control exercised over the machine components in the performance of the method of this invention can be obtained through the provision of a programmed computer or microprocessor following the dictates of FIGS. 10, 12 and 18 through 22. An exemplary copier, including a computer, is disclosed in U.S. patent application Ser. No. 729,451, filed Oct. 4, 1976, now U.S. Pat. No. 4,086,658, issued Apr. 25, 1978, and incorporated herein by reference. Preparation of appropriate programming is well within the skill of the art as represented by "MIRCO-PROGRAMMING, PRINCIPLES AND PRACTICES" by Samir S. Husson, published by Prentice-Hall, Englewood Cliffs, N.J., 1970, and by the many publications of the Institute of Electrical and Electronics Engineers.

What is claimed is:

1. A method for job recovery due to copy jams in a copying device during generation of at least one set of copies from a set of originals, said method comprising:

determining, at each occurrence, the originals corresponding to copies jammed during initial processing of an entire set of originals through a copying device and storing an indication of the same;

after completion of said initial processing of said entire set of originals, utilizing each stored indication of jammed copies during subsequent reprocessing of said set of originals through said copying device to make replacement copies of the originals determined to correspond to jammed copies; and combining the replacement copies with the copies made during initial processing of said originals.

2. The method of claim 1 wherein said replacement copies are made in one of a plurality of predetermined modes, and wherein said mode is selected depending upon the number of originals from which replacement copies are to be made.

3. The method of claim 2 wherein said predetermined modes include a single pass of originals and a double pass of originals through the copy machine to generate replacement copies.

4. The method of claim 1 wherein duplex copies are generated from said set of originals, and wherein the originals corresponding to jammed copies include originals corresponding to both sides of the jammed duplex copies whereby replacement duplex copies are generated during reprocessing of said plurality of originals.

5. The method of claim 4 wherein said duplex copies are generated from a set of simplex originals.

6. The method of claim 5 wherein replacement duplex copies are generated by a single pass of said set of simplex originals through the copying device during reprocessing of said set of simplex originals.

7. The method of claim 5 wherein replacement duplex copies are generated by a double pass of said set of simplex originals through the copying device during reprocessing of said set of simplex originals.

8. The method of claim 4 wherein said duplex copies are generated from a set of duplex originals.

9. The method of claim 8 wherein replacement duplex copies are generated by a single pass of said set of duplex originals through the copying device during reprocessing of said set of duplex originals.

10. The method of claim 8 wherein replacement duplex copies are generated by a double pass of said set of duplex originals through the copying device during reprocessing of said set of duplex originals.

11. The method of claim 4 wherein said replacement copies are generated from one of simplex and duplex orignals, and wherein the mode for generating said replacement copies is selected from one of single and double pass of originals through the copying machine.

12. The method of claim 4 wherein said set of originals are initially processed by twice passing said originals through said copying device with copy jams occurring during the second pass being determined at each occurrence for generation of said replacement duplex copies.

13. The method of claim 1 wherein said method includes placing flagging means in said set of copies generated during said initial processing of said originals to flag the position within said set of copies of missing copies due to jams, and wherein said replacement copies are inserted in place of said flagging means when said replacement copies are combined with the copies made during initial processing of the set of originals.

14. The method of claim 1 wherein said method includes clearing each jammed copy from said copying device and completing the initial processing of said set of originals prior to generation of replacement copies.

15. A method for job recovery due to copy jams in a copying device during generation of at least one set of duplex copies from a set of originals, said method comprising:

determining, at each occurrence, the originals corresponding to copies jammed during initial processing of a set of originals through a copying device to generate a set of duplex copies;

placing flagging sheets in said set of duplex copies generated during initial processing of said set of originals to flag the position of copies missing due to jams occurring during said initial processing of said set of originals;

generating replacement duplex copies of originals determined to correspond to jammed copies; and inserting said replacement duplex copies in said set of duplex copies to replace said flagging sheets therein.

16. The method of claim 15 wherein said method includes storing an indication of those originals determined to correspond to said jammed copies, and utilizing said stored indications to generate replacement duplex copies during reprocessing of said set of originals through said copying device.

17. The method of claim 16 wherein said set of originals are twice run through said copying device to generate said set of duplex copies, and wherein the originals corresponding to both sides of duplex copies jammed during second side copying of said set of originals are determined to enable generation of replacement duplex copies therefrom.

18. A method for generation of at least one complete set of duplex copies from a set of originals, said method comprising:

processing a set of originals through a copying device to provide copy on one side of a set of copy sheets;

positioning said set of copy sheets for copying on the opposite side thereof;

reprocessing said set of originals through said copying device to provide copy on the opposite side of said set of copy sheets;

clearing copy sheet jams occuring during processing and reprocessing of said set of originals through said copying device;

remaking copies of any copy sheets jammed during processing of said set of originals through said copying device after clearing of said jammed copy sheets from said copying device;

providing an indication of copy sheet jams occurring during said reprocessing of said set of originals and storing the same;

again processing said set of originals through said copying device and utilizing said indication of the location of copy jams to make replacement duplex copies of missing duplex copy sheets; and inserting the replacement duplex copies in the set of duplex copies generated during processing and reprocessing of the set of originals to replace the missing copies therein.

19. The method of claim 18 wherein said processing and reprocessing of said set of originals includes generation of a plurality of sets of duplex copy sheets, and wherein sufficient replacement copies are generated to permit generation of a plurality of complete sets of duplex copies.

20. The method of claim 18 wherein the location of said missing duplex copy sheets are flagged by inserting blank sheets in said set of duplex copy sheets generated during reprocessing of said set of originals, and wherein said replacement duplex copies are inserted at the locations flagged by said blank sheets.

21. The method of claim 18 wherein said copies are collected during processing, reprocessing and again processing of said set of originals by selection from a plurality of copy collection modes including collate, stack, back-collate and back-stack.

22. A method for generation of at least one complete set of duplex copies from a set of originals, said method comprising:

processing a set of originals through a copying device to provide copy on one side of a set of copy sheets;

positioning said set of copy sheets for copying on the opposite side thereof;

reprocessing said set of originals through said copying device to provide copy on the opposite side of said copy sheets;

stopping said copying device when a copy sheet jam occurs;

clearing jammed copy sheets occurring during processing and reprocessing of said set of originals through said copying device;

providing an indication of copy sheet jams occurring during said reprocessing of said set of originals and storing the same;

restarting the copying device after a copy sheet jam has been cleared;

repositioning the set of originals to make replacement duplex copies therefrom;

again processing the repositioned set of originals through said copying device and utilizing said stored indications of the location of copy sheet jams to make replacement duplex copies of missing duplex copy sheets; and inserting the replacement duplex copies in said set of duplex copy sheets generated during processing and reprocessing of said set of originals to replace the missing copies therein.

23. The method of claim 22 wherein said set of originals are simplex originals every other one of which is copied during processing and reprocessing with the originals being copied during reprocessing being different than said originals copied during processing whereby duplex copies of adjacent simplex originals are generated during copying, and wherein replacement duplex copies are generated by processing said set of originals through the copying device with the first side of missing copy sheets being copied from the simplex original immediately preceeding the original corresponding to a jammed second side copy and the second side of said missing copy sheets being copied from said original corresponding to the jammed second side copy.

24. The method of claim 22 wherein said set of originals are duplex originals one side of which are copied during processing and the other side of which are copied during reprocessing of said set of originals to generate said set of duplex copies, and wherein replacement duplex copies are generated by processing said set of originals through the copying device with a first side of missing copy sheets being copied from one side of the duplex originals corresponding to a jammed copy sheet and the other side of the missing copy sheets being copied from the other side of said duplex originals corresponding to a jammed copy sheet.

25. The method of claim 22 wherein the location of missing duplex copy sheets due to copy sheet jams are flagged in the duplex copy sheets generated during reprocessing of said set of originals, and wherein said replacement duplex copies are inserted in said set of duplex copy sheets generated during processing and reprocessing of said set of originals at the flagged locations of missing copy sheets.

26. An apparatus for job recovery due to copy jams in a copy machine during generation of at least one set of copies from a set of originals, said apparatus comprising:

means for determining, at each occurrence, the originals corresponding to copies jammed during initial processing of an entire set of originals through a copy machine;

means connected with said determining means for storing indications of originals determined to correspond to said jammed copies; and means connected with said storing means for causing the generation of replacement copies, after completion of said initial processing of said entire set of originals, to replace said jammed copies during subsequent reprocessing of said set of originals through said copy machine to assure complete copying of said set of originals.

27. The apparatus of claim 26 wherein said determining means includes counter means, wherein said storing means includes memory means, and wherein said means for causing generation of replacement copies includes comparator means.

28. The apparatus of claim 27 wherein said copy machine generates duplex copies and wherein said means for causing generation of replacement copies includes means for causing generation of duplex replacement copies.

29. The apparatus of claim 28 wherein said means for causing generation of duplex replacement copies includes mode selection means connected with said counter means and responsive to an input indicative of the type of originals copied automatically selecting the mode for effecting job recovery.

30. The apparatus of claim 29 wherein said mode selection means selects one of four modes including copying of simplex originals utilizing a single pass of originals through the copying machine, copying of simplex originals utilizing a double pass of originals through the copy machine, copying of duplex originals utilizing a single pass of originals through the copy machine, and copying of duplex originals utilizing a double pass of originals through the copy machine.

31. The apparatus of claim 26 wherein said apparatus includes indicator means for displaying operational messages whereby copies and replacement copies can be semiautomatically generated by the copy machine.

32. The apparatus of claim 26 wherein said means for causing generation of replacement copies includes means for controlling the manner of collecting generated copies to facilitate job recovery.

33. The apparatus of claim 26 wherein said apparatus includes flagging means responsive to a copy jam causing flagging sheets to be inserted in said set of copies to flag the location of copies missing due to said jam.

34. A control system for effecting job recovery due to copies jammed in a copy machine during initial processing of said originals to generate at least one set of copies from a set of originals, said control system comprising:

jam position indicating means for receiving signals indicative of copy jams in a copy machine during initial processing of an entire set of originals and storing the position of originals corresponding to jammed copies within said set of originals; and means connected with said jam position indicating means for causing generation of replacement copies, after completion of said initial processing of said entire set of originals, with said replacement copies being generated from the originals corresponding to jammed copies during subsequent reprocessing of said set of originals.

35. The control system of claim 34 wherein said position indicating means includes a plurality of counters and memory registers connected with a plurality of comparators whereby the position of jammed copies is determined and stored.

36. The control system of claim 35 wherein said plurality of counters includes an originals counter, a register pointer counter, and a jammed copies counter.

37. The control system of claim 35 wherein said memory registers include an originals count register stack, a jammed copies register stack, and a duplex original total count register.

38. The control system of claim 35 wherein said plurality of comparators includes four comparators connected in separate pairs with each of said pairs being connected with different ones of said counters and memory registers.

39. The control system of claim 38 wherein said means for causing generation of replacement copies includes logic circuitry connected with said comparators.

40. A control system for effecting job recovery due to copies jammed in a copy machine during initial processing of a set of originals to generate at least one set of duplex copies from said set of originals, said control system comprising:

an originals counter that is incremented each time an original of said set of originals is fed through said copy machine;

a duplex originals total count memory register connected with said originals counter;

a register pointer counter;

an originals count memory register stack connected with said register pointer counter and said duplex originals total count memory register;

a jammed copies counter;

a jammed copies count memory register stack connected with said jammed copies counter and said register pointer counter;

a plurality of comparators connected in pairs with different ones of said counters and memory registers to provide outputs indicative of the positioning of originals corresponding to jammed copies; and logic circuitry means connected with said set of comparators to receive the outputs therefrom and responsive thereto causing generation of replacement copies from said originals.

41. The system of claim 40 wherein said plurality of comparators includes a first comparator connected with said originals counter and said duplex originals total count register memory, a second comparator connected with said first comparator and said originals counter and originals count memory register stack, a third comparator receiving a copy select input and a copy count input, and a fourth comparator connected with said third comparator and said jam copies count memory register stack.

42. The control system of claim 40 wherein said logic circuitry means includes a plurality of logic gates and a plurality of flip-flops for causing generation of said replacement copies.

43. In a control system for effecting job recovery due to copies jammed in a copy machine during initial processing of a set of originals to generate at least one set of duplex copies from said set of originals, a mode selection device for automatically selecting one of a plurality of modes for generating replacement copies corresponding to copies jammed during said initial processing of said set of originals, said mode selection device comprising:

counter means for storing the number of originals to be recopied due to copies jammed in the copy machine during initial processing of the set of originals and providing an output indicative thereof;

comparator means for receiving the output from said counter means and comparing the same with at least one predetermined value, said comparator means providing outputs indicative of the results of said comparison; and circuit means including gate means connected with said comparator means to receive the output therefrom and responsive thereto automatically selecting one of said plurality of modes for job recovery for generation of said replacement copies.

44. The mode selection device of claim 43 wherein said counter means is a register pointer counter, wherein said gate means are AND gates, and wherein said circuit means includes flip-flops connected with said AND gates.

45. The mode selection device of claim 43 wherein said comparator means includes means for comparing said output from said counter means with first and second predetermined values with said comparator means providing output indicative of each comparison, wherein said set of originals initially processed are one of simplex and duplex originals, wherein said gate means receives an input indicative of the type of originals processed, and wherein said circuit means includes means for selecting one of four modes for job recovery depending upon the type of originals processed and the number of originals to be utilized in making replacement copies.

46. The mode selection device of claim 45 wherein said four selectable modes are copying of simplex originals utilizing a single pass of originals, copying of simplex originals utilizing a double pass of originals, copying of duplex originals utilizing a single pass of originals, and copying of duplex originals utilizing a double pass of originals.

47. In a control system for effecting job recovery due to copies jammed in a copy machine during initial processing of a set of originals to generate at least one set of duplex copies from said set of originals, a copy collection mode device for automatically selecting modes for copy collection during initial processing of said set of originals and during generation of replacement copies corresponding to copies jammed during said initial processing of said set of originals, said copy collection mode device comprising:

means for establishing a plurality of selectable modes for copy collection including stacking, collating, back-stacking and back-collating, said establishing means providing an output indicative of each selected mode for enabling copy collection in the mode selected;

copy collection control means connected with said establishing means for controlling copy collection in response to a received output from said establishing means indicative of a selected mode; and circuit means connected with said establishing means for effecting selection of the mode of copy collection.

48. The copy collection mode device of claim 47 wherein said establishing means includes a plurality of flip-flops, and wherein said circuit means includes a plurality of logic gates.

* * * * *